US008899445B2

(12) United States Patent
Rasmussen

(10) Patent No.: US 8,899,445 B2
(45) Date of Patent: Dec. 2, 2014

(54) ASSEMBLY FOR DISPENSING BEVERAGE

(75) Inventor: Jan N. Rasmussen, Ølstykke (DK)
(73) Assignee: Carlsberg Breweries A/S, Copenhagen V (DK)

( * ) Notice: Subject to any disclaimer, the term of this patent is extended or adjusted under 35 U.S.C. 154(b) by 1997 days.

(21) Appl. No.: 12/063,504
(22) PCT Filed: Aug. 10, 2006
(86) PCT No.: PCT/DK2006/000440
§ 371 (c)(1),
(2), (4) Date: Mar. 25, 2010
(87) PCT Pub. No.: WO2007/019853
PCT Pub. Date: Feb. 22, 2007
(65) Prior Publication Data
US 2010/0176149 A1 Jul. 15, 2010
(30) Foreign Application Priority Data

| | | |
|---|---|---|
| Aug. 12, 2005 | (DK) | 2005 01148 |
| Mar. 14, 2006 | (DK) | 2006 00364 |
| Jun. 12, 2006 | (DK) | 2006 00794 |

(51) Int. Cl.

| | |
|---|---|
| ***B65D 35/56*** | (2006.01) |
| ***B65D 35/02*** | (2006.01) |
| ***B67D 1/04*** | (2006.01) |
| ***B67D 1/06*** | (2006.01) |
| ***B67D 1/08*** | (2006.01) |
| ***B67D 1/12*** | (2006.01) |
| ***B67D 1/14*** | (2006.01) |

(52) U.S. Cl.
CPC ..... *B65D 35/02* (2013.01); *B67D 1/0462* (2013.01); *B67D 1/06* (2013.01); *B67D 1/0857* (2013.01); *B67D 1/0868* (2013.01); *B67D 1/0878* (2013.01); *B67D 1/1245* (2013.01); *B67D 1/1252* (2013.01); *B67D 1/1272* (2013.01); *B67D 1/1275* (2013.01); *B67D 1/1416* (2013.01); *B67D 1/1422* (2013.01); *B67D 1/1466* (2013.01); *B67D 2001/0828* (2013.01); *B67D 2210/00031* (2013.01); *B67D 2210/00039* (2013.01); *B67D 2210/00041* (2013.01); *B67D 2210/00052* (2013.01); *B67D 2210/00118* (2013.01)
USPC ..... 222/105; 222/326; 222/386.5; 222/389; 222/399; 222/530; 62/396
(58) Field of Classification Search
USPC ..... 222/394, 146.6, 164–165, 80–91, 105, 222/325–326, 386.5, 389, 527, 530; 62/389, 391, 394–396, 399–400
See application file for complete search history.

(56) References Cited

U.S. PATENT DOCUMENTS 2,019,034 A * 10/1935 Max ..... 62/397
2,191,918 A * 2/1940 Stadtfeld ..... 222/131
(Continued)

FOREIGN PATENT DOCUMENTS

WO WO 00/03944 1/2000
WO WO 2004/050539 6/2004
(Continued)

*Primary Examiner* — Paul R. Durand
*Assistant Examiner* — Andrew P Bainbridge
(74) *Attorney, Agent, or Firm* — Klein, O'Neill & Singh, LLP

(57) ABSTRACT

A beverage-dispensing assembly includes a collapsible beverage container having an outlet; a pressure chamber containing the container and including a lid having an opening, the pressure chamber being operable to apply a pressure to the container; a dispensing line having an inlet end and extending through the lid opening to a dispensing tap; and a connecting element fixing the lid to the container around the outlet so as to align the lid opening with the inlet end of the dispensing line, and to fluidly connect the dispensing line inlet end with the container outlet. The connecting element may include a sealing member that closes the container outlet and a piercer connected to the inlet end of the dispensing line that is configured to pierce the sealing member to fluidly connect the inlet end of the dispensing line to the container outlet in response to the pressure applied to the container.

49 Claims, 22 Drawing Sheets

(56) References Cited

U.S. PATENT DOCUMENTS

| | | | | |
|---|---|---|---|---|
| 2,211,428 | A * | 8/1940 | Matot | 312/140.1 |
| 4,921,135 | A * | 5/1990 | Pleet | 222/82 |
| 5,240,144 | A * | 8/1993 | Feldman | 222/82 |
| 5,251,787 | A | 10/1993 | Simson | |
| 5,826,752 | A * | 10/1998 | Latimer | 222/105 |
| 6,182,863 | B1 * | 2/2001 | Van Der Meer et al. | 222/105 |
| 6,375,048 | B1 * | 4/2002 | van der Meer et al. | 222/396 |
| 6,419,121 | B1 * | 7/2002 | Gutierrez et al. | 222/146.5 |
| 6,502,724 | B1 * | 1/2003 | Kelpach | 222/146.6 |
| 6,824,017 | B2 | 11/2004 | Sluijter | |
| 7,188,751 | B2 | 3/2007 | Van Der Klaauw et al. | |
| 7,604,147 | B2 | 10/2009 | Anderson | |
| 7,810,679 | B2 | 10/2010 | Wauters et al. | |
| 8,360,277 | B2 * | 1/2013 | Rasmussen | 222/83.5 |
| 2003/0062383 | A1 | 4/2003 | Meike et al. | |
| 2003/0071067 | A1 | 4/2003 | Sluijter | |
| 2003/0173376 | A1 | 9/2003 | Bilskie et al. | |
| 2004/0007589 | A1 * | 1/2004 | Leveen | 222/95 |
| 2005/0103802 | A1 * | 5/2005 | Alberg | 222/105 |
| 2006/0186136 | A1 | 8/2006 | Wauters et al. | |
| 2010/0176149 | A1 | 7/2010 | Rasmussen | |
| 2010/0252583 | A1 | 10/2010 | Maas et al. | |

FOREIGN PATENT DOCUMENTS

| | | |
|---|---|---|
| WO | WO 2004/050541 | 6/2004 |
| WO | WO 2004/051163 | 6/2004 |
| WO | WO 2004/099060 | 11/2004 |

* cited by examiner

Fig. 6
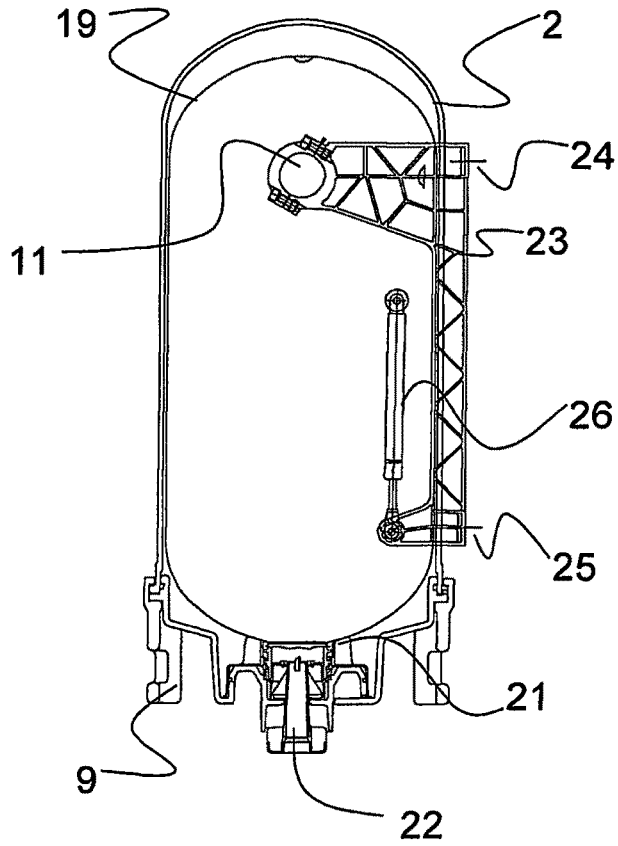
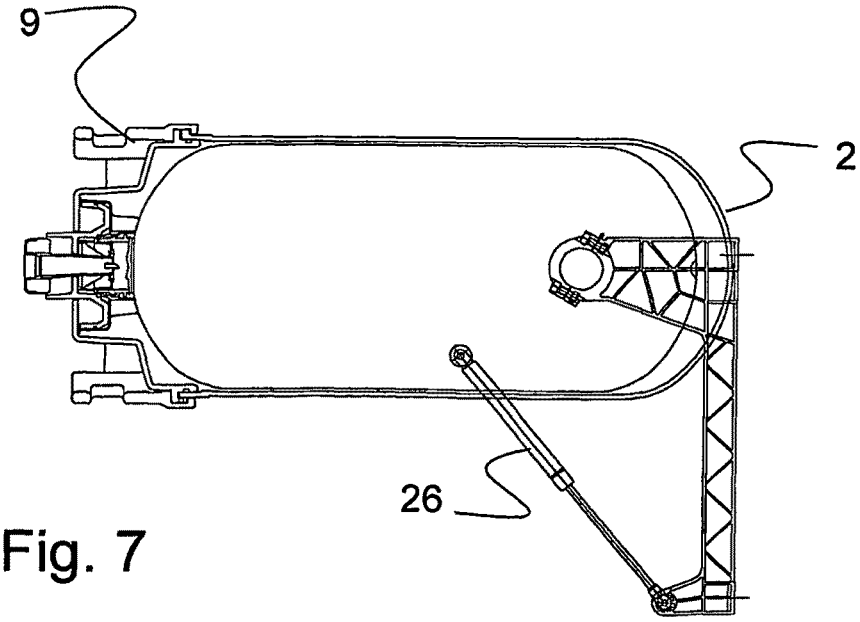
Fig. 7

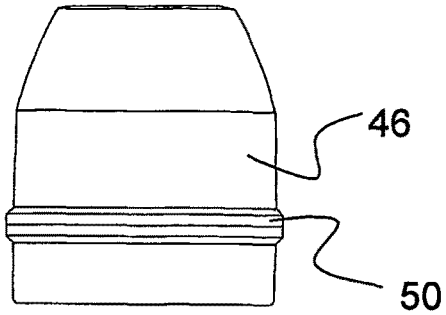
Fig. 23
Fig. 24
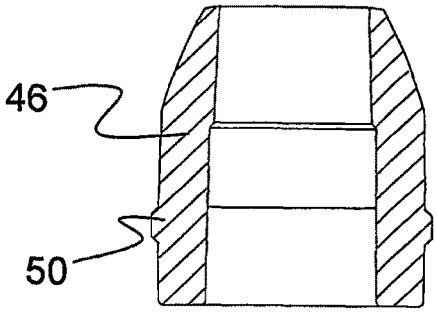
Fig. 25
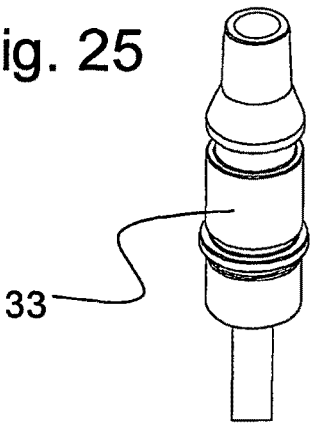
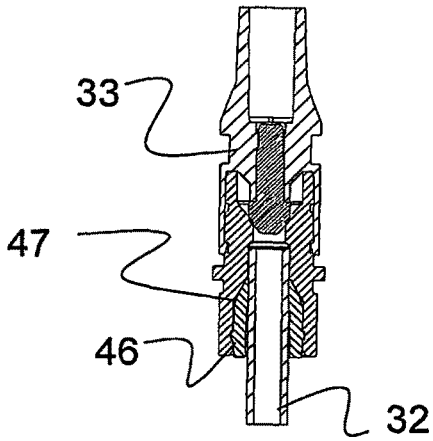
Fig. 26

ASSEMBLY FOR DISPENSING BEVERAGE

CROSS REFERENCE TO RELATED APPLICATION

This application is the national phase entry, under 35 U.S.C. §371(c), of co-pending International Application No. PCT/DK2006/000440, filed Aug. 10, 2006, the disclosure of which is incorporated herein by reference in its entirety.

FEDERALLY SPONSORED RESEARCH OR DEVELOPMENT

Not Applicable

FIELD OF THE INVENTION

The present invention relates to an assembly for dispensing beverage.

BACKGROUND ART

Large-volume carbonated beverages, such as draught beer, are conventionally delivered to the place of consumption in metal kegs that typically hold a large volume of e.g. 25 liters. Such kegs are intended for expensive and elaborate dispensing assemblies comprising draught beer coolers, carbondioxide cartridges, etc., for cooling and dispensing the beverage from the container. Such kegs and dispensing assemblies are well known in the art.

The metal kegs are heavy, and thus difficult to handle, and cause excessive transportation costs. Furthermore, metal kegs have high manufacturing costs, and need to be collected for refilling after complete or partial emptying.

A keg is reused several times before it is scrapped. Consequently, kegs travel long distances in their life-time and the heavier they are the higher the transportation cost is. Additionally, the consumption of draught beer is very sensitive to seasonal variation. Especially in summer periods consumption is high, while in colder periods consumption is low. Therefore, to be able to meet the demand a large number of kegs must be in circulation causing storage of plenty of empty kegs during periods of low consumption.

Another disadvantage of the known draught beer assemblies is that many parts, which are in contact with the beverage, are reused and therefore require regular cleaning in order to keep the parts hygienically clean and to prevent bacteria growth. The cleaning is time consuming and it may be difficult to perform sufficiently thorough cleaning of all the parts. If the parts that are in contact with the beverage are not cleaned thoroughly it will influence the quality of the beverage.

To overcome some of these disadvantages beverage containers for dispensing assemblies produced in lighter, more flexible materials have been introduced. Plastic bags emptied by pressing out the content mechanically, pneumatically or hydraulically have been tested, but are too fragile for most practical purposes.

Also dispensing from collapsible beverage bottles made of plastics materials, e.g. PET, are known in the art. These bottles are emptied by collapse of the bottle wall by application of mechanical, pneumatic or hydraulic pressure causing the content to be squeezed out. Such beverage bottles contain only small volumes, such as a few liters, and are not directly comparable to metal kegs, which hold a substantially larger volume of beverage. However, the collapsible bottles have a number of advantages over metal kegs in many aspects.

Plastic materials can be ground up, and the resulting granulate can be used in production of new plastics materials. The granulate takes up little space, thus eliminating the need for large storage. Since the bottles are lighter, they are easier to handle and involve smaller transportation costs. Plastic bottles can be made transparent to allow visual inspection of the content or they can be dyed in any desired color. When emptied the bottle is collapsed and will take up little space during transportation for recycling.

A dispensing assembly with a collapsible beverage bottle is for example known from EP-A1-1 003 686. This apparatus constitutes an integrated dispensing device comprising a housing with a lid, sealing means, a pressure source, a cooling device and a dispensing tap.

The dispensing apparatus has a complicated design, comprising a vast number of parts, the parts themselves being elaborate, costly devices. There is thus a need for providing an assembly for dispensing beverage which has a simple design and construction wherein beverage containers though being relatively heavy may be handled by a user.

Furthermore, the market for gourmet-type beverages, such as special kinds of ale, pilsner and stout beers, steadily increases, therefore the demand for these products as draught-beers also increases. This is partly a consequence of the fact that ideal circumstances for such properties as pressure, temperature and foaming are more easily obtained in a draught system as compared to serving beverages from bottles or cans. Thus, to achieve the optimal taste, aroma and texture of e.g. a beer, it is often necessary to serve the beer from a draught system. As both the number of gourmet beverage products and the customer demand for these products increases, it becomes essential for establishments such as restaurants, bars and pubs to offer a large variety of different beverages at the right quality. Thus, it is becoming increasingly more common for bars and pubs to offer a large number of different quality draught beverages in order to meet the demand of customers.

There is thus a need for providing professionals as well as private people with a large selection of quality beverages. There is also a need for providing these quality beverages in a form, which brings out the best in the beverage and thus ensures high customer satisfaction. There is furthermore a constant need for reducing the costs of such quality products as well as a need for increasing user-friendliness of systems for dispensing quality beverages.

Often the prior art devices for dispensing beverage have the disadvantage that they need to be set up by professionals for delivering the quality beverage to the customer. The matter is that the beverage often is being dispensed under influence from several exterior parameters such as pressure, gasses, temperatures, etc., which may be impossible for the user of the devices to handle, and in the case that a device has been set up wrong the dispensed beverage will not exhibit the intended quality.

It is an objective of the present invention to provide a remedy to the above-mentioned disadvantages of the known techniques. It is more specifically an objective of the present invention to provide a flexible assembly for dispensing a beverage, which makes it possible, easy and inexpensive to dispense quality beverages to a customer.

SUMMARY OF THE INVENTION

The above objects, together with numerous other objects, advantages and features, which will become evident from the below description, are accomplished by a solution in accordance with the present invention by an assembly for dispensing a beverage, said assembly comprising a heat transfer system, said heat transfer system being adapted to provide cooling or heating to at least a pressure chamber;

said pressure chamber being adapted during use to accommodate a beverage container, said beverage container being made of a collapsible material and a connecting element being arranged at an outlet of the beverage container;

said pressure chamber comprises a wall and a lid defining the accommodation for the beverage container;

said pressure chamber is furthermore provided with a pressure source, said pressure source being adapted to provide a predetermined pressure to the pressure chamber; and during use of the assembly a dispensing line is connected with an outlet of said beverage container and extends from the outlet through an opening in the lid of the pressure chamber to a dispensing tap;

wherein the dispensing of beverage is carried out by providing the predetermined pressure to the pressure chamber, and as the dispensing line is being opened at the dispensing tap, the pressure will apply a pressure to the exterior of the beverage container, which will start to collapse, whereby the beverage will be forced out of the beverage container into the dispensing line and out at the dispensing tap without said beverage per se being supplied with or being in contact with any gas during the dispensing.

Hereby it is obtained that the beverage contained in the beverage container may be dispensed without said beverage per se being supplied with or being in contact with any gas during the dispensing, so that the taste, texture, and feeling of the beverage after dispensing are as intended from the manufacturer of the beverage. It is also obtained that the assembly is in balance, i.e. the exterior parameters, which may influence the beverage, are essentially eliminated to an imperceptible level. Furthermore, it is obtained that the assembly is simple and flexible in construction as well as being easy to use, and that it breaks with the long established mindset within the business both with what concerns the construction of the assemblies, the design, the logistics of the beverage containers, as well as with the maintenance and service of the assemblies.

Additionally, an internationally recognized and commonly used taste test of a beverage dispensed from an assembly according to the present invention has shown that the beverage displays considerably improved quality of taste when compared to beverages from previously known dispensing assemblies (evaluation and rating by an expert panel of off-flavors of the beverages). The difference is very marked after having had opened containers, e.g. beer kegs, in the assemblies for a longer period of time, such as 3-4 weeks. This means that the beverage being dispensed to the consumer is generally of an improved quality as compared to beverage from known assemblies. Furthermore, the shelf life of an open beverage container in an assembly is considerably prolonged. Thus, even users having a relatively low turn over of beverage can employ assemblies of the kind disclosed herein without having to discard half-full kegs due to the extremely limited shelf-life experienced with the known systems (typically around one week).

In addition the heat transfer system may be a cooling system, said cooling system may comprise a cooling unit such as a refrigerator.

Furthermore, ventilation means may be arranged for ventilating the air in the cooling unit.

The pressure chamber may be arranged as a cooling unit, which is expedient when the pressure chamber is adapted to accommodate small beverage containers, for instance in connection with home dispensing devices.

According to the invention the cooling of the cooling unit may be performed by means of liquid cooling systems, gas cooling systems, Peltier cooling systems, or the like.

In expedient manner according to the invention a temperature sensor may be arranged in connection with the cooling unit for measuring the temperature of the cooling unit. Furthermore a control unit may be arranged for controlling the cooling of the cooling unit so that a predetermined temperature of the cooling unit and thereby of the content of the beverage container can be obtained.

For minimizing the expenses for manufacturing the assembly, the cooling unit may substantially be made in one piece by injection molding or by punching. The cooling unit may be made of moldable materials, such as plastic, or of metal.

Advantageously, the cooling unit may be adapted to contain one or more beverage container(s) for precooling. The cooling unit may comprise a door for closing off to the environment.

Also, for minimizing the expenses for manufacturing the assembly as vell as for creating a homogeneous pressure chamber, the wall of the pressure chamber may substantially be made in one piece by injection molding or by punching. The wall of the pressure chamber is made of moldable materials, such as plastic, or of metal.

According to the invention, the lid may close off the pressure chamber. Advantageously, the lid may be detachable from or pivotably attached to the pressure chamber. In addition, the opening in the lid may substantially be at the center of the lid.

The lid may be closed to the chamber by closing means such as by threading, by a bayonet closure or screw shackle lock.

According to the invention, the pressure chamber may be arranged to be pivotable so that access to the pressure chamber is facilitated. For enabling this, pivot means may be arranged at the top of the pressure chamber, at the bottom of the pressure chamber or at the middle of the pressure chamber.

In a preferred embodiment the pivot means may be arranged at the top of the pressure chamber so that the center of rotation of the pressure chamber is arranged at the top of the cooling unit so that when the pressure chamber is pivoted the pressure chamber will end in a high position which provides an ergonomic working position for the user.

The center of rotation of the pressure chamber may be arranged at the back of the cooling unit, which provides for additional space or room in the cooling unit in front of the pressure chamber.

Advantageously, the pressure chamber may have a first vertical position wherein it is in a use position and a second horizontal position wherein it is in a loading/unloading position. The second horizontal position of the pressure chamber may expediently be at the top of the cooling unit whereby ergonomic working positions for the user are obtained as mentioned above.

The pressure chamber may also comprise holding means for fixing the pressure chamber in a first position and a second position, respectively, so that the user is secured while handling the beverage containers.

Preferably, the pressure chamber may comprise means which enable pivoting of the pressure chamber between two positions so that pivot movement and speed may be damped.

In another embodiment of the invention, the pressure chamber may be arranged to be slidable in a vertical and/or a horizontal direction so that access to the pressure chamber is facilitated.

Slide means may be arranged at the top of the pressure chamber, at the bottom of the pressure chamber or at the middle of the pressure chamber in relation to the chosen embodiment of the pressure chamber.

According to the invention the beverage container may be substantially completely collapsed after use and said collapsed container being non-reusable as a container. The beverage container may be made of plastics, particularly a polymer, such as PEN or PET or blended PET. Advantageously, the beverage container may be a multilayer construction comprising an oxygen barrier for preserving the beverage content of the container. Also the beverage container may be tinted or dyed to create a barrier to light.

According to the invention, the beverage container may be contained inside a packaging box made of, for instance cardboard, before being loaded into the pressure chamber. Hereby it is obtained that the packaging box supports the beverage container. Furthermore, the surfaces of the packaging box may be used to display the label or type of the beverage.

The packaging box may comprise a bottom part, which is adapted to support the beverage container, and a top part, which is adapted to be removed from the bottom part. This is expedient in the case where heavy beverage containers are to be handled due to the fact that they may be too heavy to lift up the entire packaging box.

The top part may be removed before the beverage container and the bottom part is placed in the cooling unit for precooling, which facilitates better cooling because the packaging may have an isolating effect on the beverage container and thereby on the content of the container.

Advantageously, the connecting element may be adapted for abutment with the lid of the pressure chamber so that a sealing between the lid and beverage container is obtained. For providing easier handling of the beverage container during the filling of beverage the connecting element may comprise a membrane for sealing of the outlet of the beverage container.

Optionally, a second membrane may be arranged as a part of the connecting element. Such a second membrane may provide additional sealing of the beverage container and may be preferable when incorporating the beverage container into existing beverage dispensing systems.

According to a preferred embodiment of the invention the connecting element may comprise a piercer, said piercer being adapted to pierce the membrane when a predetermined pressure is obtained inside the pressure chamber. An inlet end of the dispensing line may be arranged in connection with the piercer.

According to the invention the inlet end of the dispensing line may be obliquely cut so that the oblique end of the dispensing line is adapted to pierce the membrane when a predetermined pressure is obtained inside the pressure chamber.

Advantageously, a sealing element may be arranged at the inside of the lid and the connecting element during use. The sealing element may be a ring comprising a main part, a lip and a plurality of taps placed around the main part with a mutual spacing on the opposite side of the lip.

In an embodiment according to the invention a valve may be arranged at the outlet end of the dispensing line. The valve may be interchangeable. Furthermore, the interchangeable dispensing valve may be arranged at a downstream end of the dispensing line and is arranged in connection with interaction means, said interaction means being adapted for affecting a specific kind of beverage being dispensed, as to achieve a beverage-specific dispensing.

In another preferred embodiment the interaction means is an integral part of the interchangeable valve. By the expression "the interaction means is an integral part of the interchangeable valve" is meant that the interaction means is constructed as a part of the valve and is inseparable from said valve. The matter is that the interaction means by being an integral part of the valve can easily be manufactured, supplied and removed along with the valve.

In expedient manner according to the invention a tower may be arranged in connection with the cooling unit. The dispensing tap may be arranged at the tower.

Advantageously, the tower may have an outer wall defining an inside first channel between a first end and a second end of the tower, where at least two channels are arranged in said first channel: a second channel for accommodating a dispensing line, and a third channel which is in fluid communication with said second channel at the second end of the tower. The first channel may comprise isolation material, such as a gas, foam, or heat reflective material, for isolation of either the second channel, the third channel or both. In addition, the second channel and the third channel may extend a distance from the first end of the tower to the cooling unit, said channels being isolated along this distance. Moreover, the cooling system may comprise means for cooling of the dispensing line, such as by gas or liquid cooling.

Furthermore, the dispensing line may comprise at least two sections: a first section having a length $L_1$ and an inner cross-sectional area $A_1$, and a second section downstream of said first section, having a length $L_2$ and an inner cross-sectional area $A_2$, where $A_1$ is smaller than $A_2$ so that a pressure drop of the beverage flowing through the dispensing line is obtained.

In a particularly preferred embodiment the dispensing line may advantageously be made of a polymer material and produced by cold rolling. The dispensing line may for instance be obtained by cold rolling of a polymer tube. The cold rolling method is usually only employed for deformation of metals and its application to polymer materials yields both very surprising and beneficial effects. By controlling the deformation rate of the material, e.g. a polymer tube, specific properties of the dispensing line can be obtained. For instance, the finished dispensing line may be substantially free of internal stress, meaning that the polymer material of the dispensing line is substantially free of internal stress and thus considerably more durable and flexible. This is a highly surprising and unexpected advantage of the production by cold rolling. The increased durability and flexibility of the material is particularly relevant for a dispensing line that often has to be rolled up, manipulated and adjusted to fit various assemblies 1. The pressure applied to the polymer material during the cold rolling may vary according to the desired final properties of the dispensing line. For instance, the pressure applied may be in the range of about 100 to about 300 gigapascal (GPa). In a specific embodiment the deformation pressure is about 200 GPa. The type of polymer material used for a dispensing line produced by cold rolling may vary, but particularly preferred materials are at least partially crystalline polymers, e.g. PE or PET. Particular advantages of producing the dispensing line out of a polymer material include increased flexibility as opposed to e.g. metal, easier and less costly production as well as more convenient, environmental and inexpensive use of the dispensing line as a disposable part.

The invention is also new and inventive by providing a beverage container made of a collapsible material and comprising a neck part having an outlet, a connecting element being arranged at the neck part of the beverage container, said connecting element comprising means for receiving an inlet end of a dispensing line.

Preferably, the beverage container may be connected to a lid of a pressure chamber by means of the connecting element, thereby obtaining a sealing between the lid and beverage container.

BRIEF DESCRIPTION OF THE DRAWINGS

The invention and its many advantages will be described in more detail below with reference to the accompanying schematic drawings, which for the purpose of illustration show some non-limiting embodiments and in which FIG. 6 shows in a side cross-sectional view a pressure chamber of the assembly shown in FIG. 1 in an operating position, FIG. 7 shows in a side cross-sectional view a pressure chamber of the assembly shown in FIG. 1 in a loading position, FIG. 23 shows a side view of a fitting, which is adapted to attach the dispensing line to a valve or a connecting element, FIG. 24 shows a cross-sectional view of the fitting shown in FIG. 23, FIG. 25 shows a valve at the end of a dispensing line, FIG. 26 shows a cross-sectional view of the valve shown in FIG. 25.

All the figures are highly schematic and not necessarily to scale, and they show only parts which are necessary in order to elucidate the invention, other parts being omitted or merely suggested.

DESCRIPTION OF PREFERRED EMBODIMENTS

Figure 1:
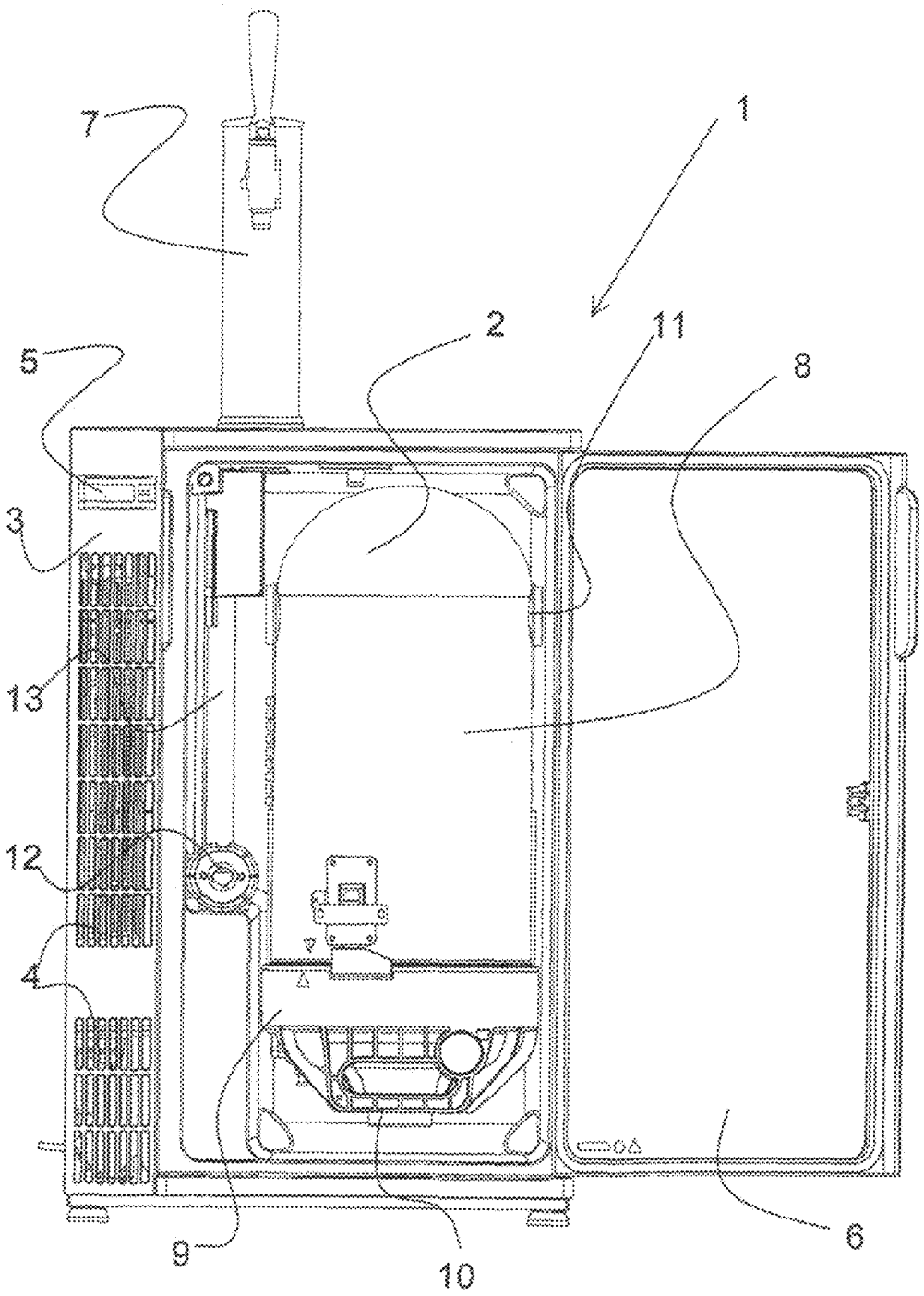
FIG. 1 shows in a front view an embodiment of an assembly for dispensing beverage according to the invention.

In FIG. 1 one embodiment of the assembly 1 according to the invention is shown schematically in a front view. In this embodiment the assembly 1 comprises a heat transfer system (not shown). It is within the inventive idea that the heat transfer system may be adapted to provide cooling or heating to at least a pressure chamber 2 of the assembly 1. The pressure chamber 2 is adapted during use to accommodate a beverage container (not shown), wherefore the heat transfer system is cooling or heating the beverage contained inside the beverage container.

The beverage may be beer, soft drinks, wine, tea, coffee, or the like, thus, the assembly is adapted to provide the right cooling or heating for the specific beverage, so that when said beverage is being served it has the right temperature for the consumer.

In the following description heat transfer system will be explained in connection with a cooling system; however, a heating system or a combination heating and cooling system may be within the inventive idea.

The assembly 1 shown in FIG. 1 further comprises a cooling unit 3 in the form of a refrigerator, wherein the pressure chamber 2 is contained. The cooling unit 3 comprises, as a refrigerator, cooling elements as well as ventilation means for circulating the cooled air inside the cooling unit 3. These elements are hidden behind the ventilation gratings 4 shown in the left side of the assembly 1. At the top right corner of the cooling chamber 3 is shown a display 5, which is adapted to indicate the temperature of the cooling unit and thereby at what temperature the beverage is supposed to be served. Obviously, if the beverage container when placed in the pressure chamber has a considerable higher temperature than the desired dispensing temperature of the beverage, a period of time will pass before the right temperature is obtained for the beverage.

For minimizing said period of time a so-called turbo-cooling is arranged in connection with the cooling unit. A temperature sensor (not shown) is arranged in connection with the cooling unit for measuring the temperature of the cooling unit. In case the temperature sensor measures a temperature which is over a predetermined maximum temperature a control unit (not shown) is adapted to initiate the so-called turbo-cooling so that the temperature of the cooling unit 3 quickly will reach the predetermined temperature for the specific beverage. In connection with the display 5 the predetermined temperature for a specific beverage may be set.

In order to minimise this disadvantage, the cooling unit 3 is adapted to accommodate an additional beverage container, which may be pre-cooled to the predetermined temperature during the emptying of the beverage container held in the pressure chamber 2, this is further described in connection with FIGS. 4 and 5 below. However, there may be a raise in temperature when the new "hot" beverage container is placed in the cooling unit 3 for precooling, in this instance the temperature sensor measures the raise in the temperature and the turbo-cooling is initiated. During tests of the assembly when placing a new "hot" beverage container in the cooling unit 3 for pre-cooling only a raise on about 0.5° C.-1.0° C. of the temperature of the beverage container held in the pressure chamber have been observed by using the turbo-cooling system. The turbo-cooling may also be initiated after loading/unloading of the beverage containers in the pressure chamber, where the user has access to the interior of the cooling unit via an opening, which normally is closed by a door 6. This may also be avoided by applying a separation in the opening in the form of an air curtain.

In this embodiment the cooling system is using air and ventilation means, however, it is within the inventive idea that the cooling also may be performed by means of liquid cooling systems, gas cooling systems, Peltier cooling systems, and the like, which will be appreciated by the skilled person.

The cooling unit 3 may substantially be made in one piece by injection molding or by punching. Advantageously, the cooling, unit 3 may be made of moldable materials, such as plastic, or of metal.

On the top of the cooling unit 3 a tower 7 is shown. The tower will be explained in more detail in connection with FIGS. 29-30 below. The tower 7 is in this embodiment of the assembly 1, placed directly at the top of the cooling unit, i.e. being an integrated part of the assembly. In this embodiment, the assembly 1 may for instance be a stand-alone unit. The outer surfaces of the cooling unit 3 may be adapted for receiving decorations, labeling or advertising materials for the specific beverage being dispensed. The cooling unit 3 may be provided with wheels (not shown) for enabling transport of the assembly 1. Within the inventive idea, the tower 7 may also be separated from the cooling unit, however, still being connected with said cooling chamber. The matter is that the assembly 1 according to the invention may easily be incorporated into the existing interior of an establishment, which serves beverage, such as restaurants, cafes, bars, pubs, and the like. This it due to the fact that the cooling unit 3 is very compact and small so that it easily could be placed under a bar or a counter next to other refrigerators without major construction wise and design wise alterations of existing interior. Thus, the design of the establishment will be intact. In one embodiment of the assembly 1 which is arranged to accommodate a 20 liter beverage container in the pressure chamber as well as an additional beverage container for pre-cooling the width is 0.5 meter, the height is 0.8 meter and the depth is 0.6 meter, which is very surprising for a skilled person. Also, the tower 7 may be optionally placed on the bar or counter and need not be supported by the assembly 1.

Furthermore, a plurality of assemblies 1 may be arranged in connection with each other thereby enabling dispensing of several different beverages. The assemblies 1 can function as individual assemblies, i.e. each having a cooling system, a pressure chamber, a pressure source, or they may function as a unit for instance sharing the same cooling system and pressure source. Within the inventive idea the cooling unit may be larger than the above-mentioned so that more than one pressure chamber is arranged in the cooling unit using the same pressure source. Hereby is obtained that different beverages may be dispensed from the same assembly at the same time. Particular embodiments of a unit comprising a plurality of pressure chambers 2 is illustrated in FIGS. 45-48. These units will be described further in connection with the figures.

In case that the assembly for dispensing beverage according to the invention is used at an establishment where a large consumption of beverage takes place and thereby a need for pre-cooling of the beverage containers is present the pressure chamber 2 may be omitted from a cooling unit 3 whereby the cooling unit 3 in question may be used for pre-cooling two beverage containers.

The pressure chamber 2 comprises a wall 8 and a lid 9 defining the accommodation for the beverage container (not shown).

The pressure chamber 2 is furthermore provided with a pressure source (not shown), said pressure source being adapted to provide a predetermined pressure to the pressure chamber 2. Furthermore, a pressure-controlling unit may be arranged in connection with said pressure source and the pressure chamber 2.

The lid 9 in this embodiment is detachable from the pressure chamber 2; however, in other embodiments it may be pivotably attached to the pressure chamber. The lid 9 may be locked to the chamber by closing means, such as by threading, by a bayonet closure or screw shackle lock or the like. Furthermore, the lid 9 comprises an opening (not shown), which preferably substantially is at the center of the lid 9.

Furthermore, the assembly comprises means 12 for aligning the opening of the lid 9 with an opening 12 of a dispensing line channel 13 so that the opening of the lid 9 can be used as a guiding element for the dispensing line (not shown). The lid 9 and the opening of dispensing line channel 13 may comprise connecting means, said connecting means being complementary to each other and adapted to attaching the lid to said opening of the dispensing line channel 13. Preferably, the connection means are arranged for coaxial alignment of the opening of the lid 9 with the opening of the dispensing line channel 13. The advantages with this embodiment will be explained in detail in connection with FIGS. 31-39 below.

The pressure chamber 2 is in FIG. 1 shown in an operating position, which in this embodiment is equal to a vertical orientation of said pressure chamber 2. The lid 9 is placed at the bottom of the pressure chamber 2 and comprises a handle 10, which facilitates handling of the pressure chamber 2. A sequence of step, which may be performed for replacing a beverage container in the pressure chamber, will be explained in connection with FIGS. 31-39 below. Within the inventive idea the pressure chamber 2 may also be accessible from the top, in which case the lid 9 as well is placed at the top of the pressure chamber. In this instance the beverage container is loaded into the pressure chamber with the opening upwards.

Advantageously, the wall of the pressure chamber substantially is made in one piece by injection molding or by punching. The wall of the pressure chamber may be made of moldable materials, such as plastic, or of metal.

The pressure chamber 2 is in this embodiment arranged pivotable so that access to the pressure chamber is facilitated. For enabling rotation of the pressure chamber 2 pivot means 11 is arranged at the top of the pressure chamber 2. The pivoting/rotation of the pressure chamber will be explained in connection with FIGS. 6-7 below. Within the inventive idea the pivot means may also be arranged at the middle or at the bottom of the pressure chamber.

By arranging the pivot means 11 at the top of the pressure chamber 2 it is obtained that the center of rotation of the pressure chamber 2 is placed at the top of the cooling unit 3. When the center of rotation of the pressure chamber 2 at the same time is arranged at the back of the cooling unit 3 it is obtained that additional room is present in the cooling unit 3 when the pressure chamber 2 is in the use position, said room may be accommodated by an additional beverage container for pre-cooling as shown in FIG. 5. An additional advantage is that when the pressure chamber 2 is pivoted into a horizontal loading/unloading position it is placed at the top of the cooling unit 3 which facilitates loading or unloading of beverage containers and provides a more ergonomic working position for the user of the assembly 1, this is especially expedient due to the handling of the heavy beverage containers when these are filled.

According to another embodiment (not shown) of the assembly 1 the pressure chamber may be arranged to be slidable in a vertical and/or a horizontal direction. Said slide means may be arranged at the top of the pressure chamber, at the bottom of the pressure chamber or at the middle of the pressure chamber. It is also within the inventive idea that instead of the lid of the pressure chamber providing access to the inside of the pressure chamber, the entire wall of the pressure chamber may be lifted off as a cover and thereby make access possible.

In the following different (not shown) examples of providing access to the pressure chamber will be described.

In one example (not shown) the pressure chamber may be arranged to be pivotable at the bottom of the pressure chamber. In case a new beverage container is to be loaded into the pressure chamber the pressure chamber is first tilted so that the top of the pressure chamber is located outside the cooling unit. In this example the pressure chamber may be supported by a structure or jig for controlling and supporting the pressure chamber during the tilting. After the top of the pressure chamber is located outside the cooling unit the cover of the pressure chamber is lifted off. The cover is placed on the floor and an empty beverage container is unloaded from the pressure chamber. Hereinafter a new, preferably pre-cooled beverage container is loaded into the pressure chamber and the cover is again put in place. The pressure chamber is then tilted in place.

In a second example (not shown) the pressure chamber is arranged on a slide placed at the bottom of the pressure chamber as mentioned above. In connection with the slide, which is adapted to move in and out of the cooling unit in a substantially horizontal direction, a vertical guide system is arranged. Preferably, the guide system is moveable with said slide. In case a new beverage container is to be loaded into the pressure chamber the pressure chamber is drawn out of the cooling unit on the slide. The cover of the pressure chamber is then lifted up on its guide system. When the cover has reached a predetermined distance, i.e. a distance, which is large enough for a new beverage container to be placed between the lifted cover and the bottom of the pressure chamber, the empty beverage container is removed and a new filled beverage container, preferably pre-cooled, is placed at the bottom of the pressure chamber. Hereinafter, the cover is moved in place and afterwards the slide with the newly loaded pressure chamber is moved back into the cooling unit. It should be mentioned that the guide system also may comprise a horizontal guiding located a distance above the slide, whereon the cover may be placed and drawn away from the guide system, thereby providing additional space for the user during the unloading/loading of the beverage containers.

In a third example (not shown) the pressure chamber is placed on a slide at the bottom. In this example two bottoms of the pressure chamber are arranged next to each other with a vertical pole arranged between them. Furthermore, the cover of the pressure chamber is connected to the pole by means of a bearing, which is adapted to be slidable up and down said pole. In case a new beverage container is to be loaded into the pressure chamber, the pressure chamber is drawn out of the cooling unit on the slide. The cover of the pressure chamber is then lifted up via the pole to a predetermined distance enabling unloading of the empty beverage container. At the bottom a pre-cooled beverage container is placed. The cover is then swung around the pole to the pre-cooled beverage container and subsequently lowered over this beverage container. A new beverage container for pre-cooling is then loaded into the empty bottom. Finally, the slide is pushed back into the cooling unit.

Figure 2:
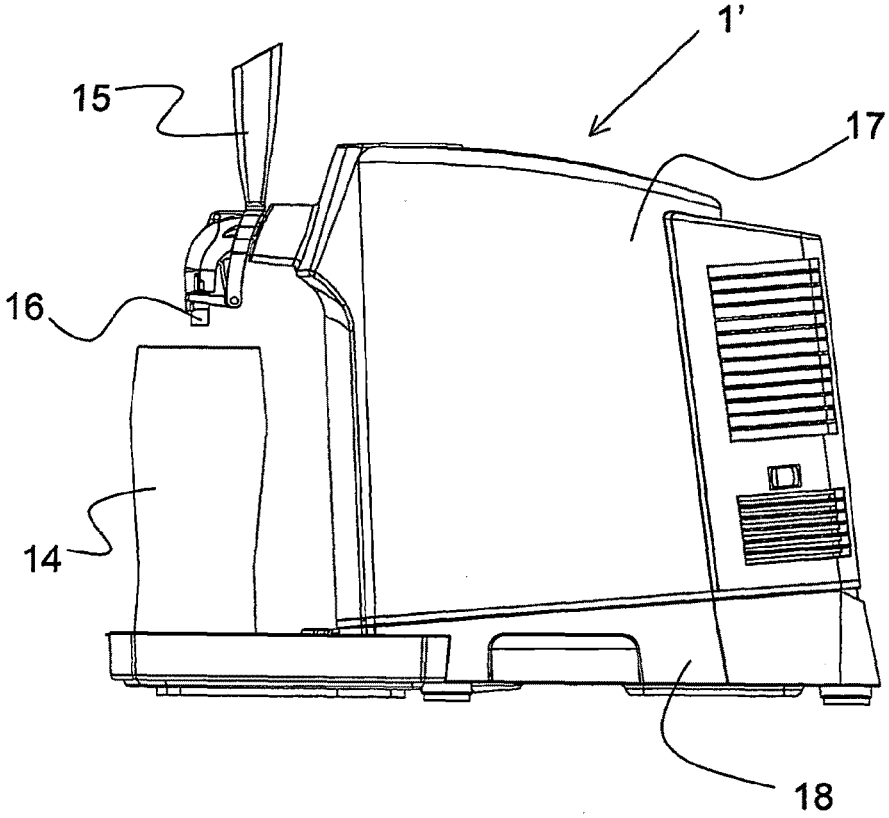
FIG. 2 shows in a side view another embodiment of an assembly for dispensing beverage according to the invention.

In FIG. 2 is another embodiment of assembly 1' according to the invention shown in a side view. This embodiment illustrates a home dispensing assembly, wherein the pressure chamber (not shown) may accommodate a beverage container containing about 5 liter. The assembly 1' is here shown in a use position ready for dispensing the beverage into a glass. Due to the compactness of this assembly 1' the pressure chamber is arranged as also being the cooling unit. The cooling of the pressure chamber is in this embodiment carried out by a Peltier cooling system, however, other types of cooling may be applied. For dispensing beverage a tap actuator 15 is arranged in connection with the outlet end 16 of the dispensing line (not shown). The assembly 1' comprises a top part 17 and a bottom part 18.

Figure 3:
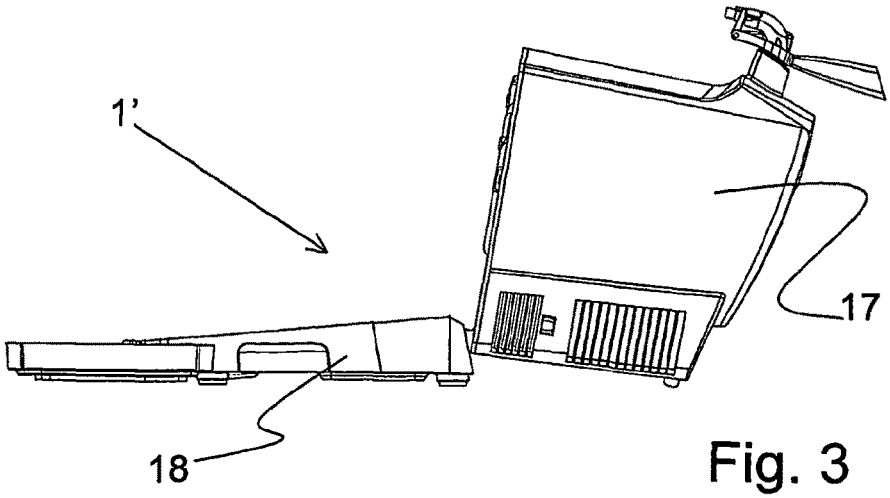
FIG. 3 shows in a side view the assembly of FIG. 2, wherein a top part have been pivoted.

FIG. 3 illustrates the assembly 1' of FIG. 2 in a loading position. In this position, the top part 17 is pivoted away from the bottom part 18. When the top part 17 is pivoted the pressure source (not shown) is disconnected from the pressure chamber, which is contained in the top part 17. Subsequently, it is possible to open the pressure chamber and unload an empty beverage container and load a new filled one. This assembly 1 is not arranged for accommodating an additional beverage container for pre-cooling; however, the beverage container used to this assembly 1' is so small that it easily fits into existing refrigerators in a normal home.

Subsequently, the pressure chamber is closed and the top part 17 is pivoted back for connection with the bottom part 18, and thereby the pressure source immediately will start to build-up pressure in the pressure chamber to enable dispensing.

Figure 4:
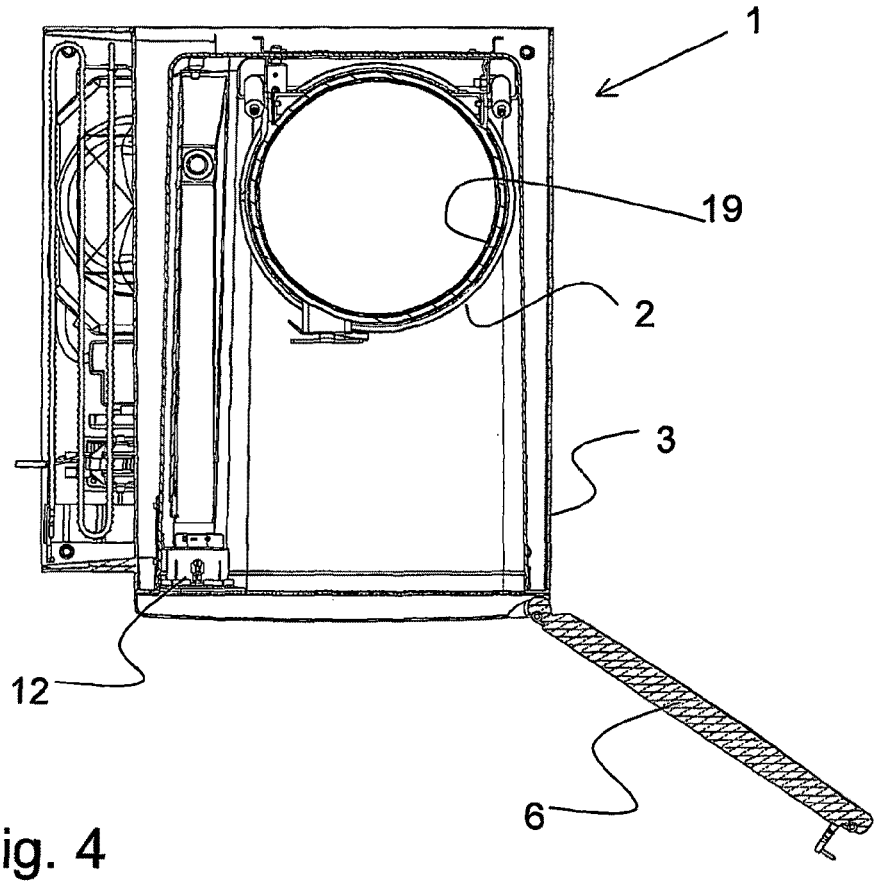
FIG. 4 shows in cross-sectional view from above the interior of the assembly of FIG. 1.

FIG. 4 shows in cross-sectional view from above, the interior of the assembly 1 shown in FIG. 1. In FIG. 4, it is shown that the pressure chamber 2 is placed in the back of the cooling unit 3. The pressure chamber 2 in this embodiment is round for accommodating a round beverage container 19. Within the inventive idea, the pressure chamber may have other geometric shapes, however, preferably a shape adapted to the cross-sectional shape of the beverage container.

Behind the pressure chamber 2 is supporting means shown for supporting the pressure chamber, this will be explained further in connection with FIGS. 6 and 7. Due to the fact that the pressure chamber 2 is arranged at the back of the cooling unit 3 there is room for an additional beverage container placed in front of the pressure chamber 2 as shown in FIG. 5.

Figure 5:
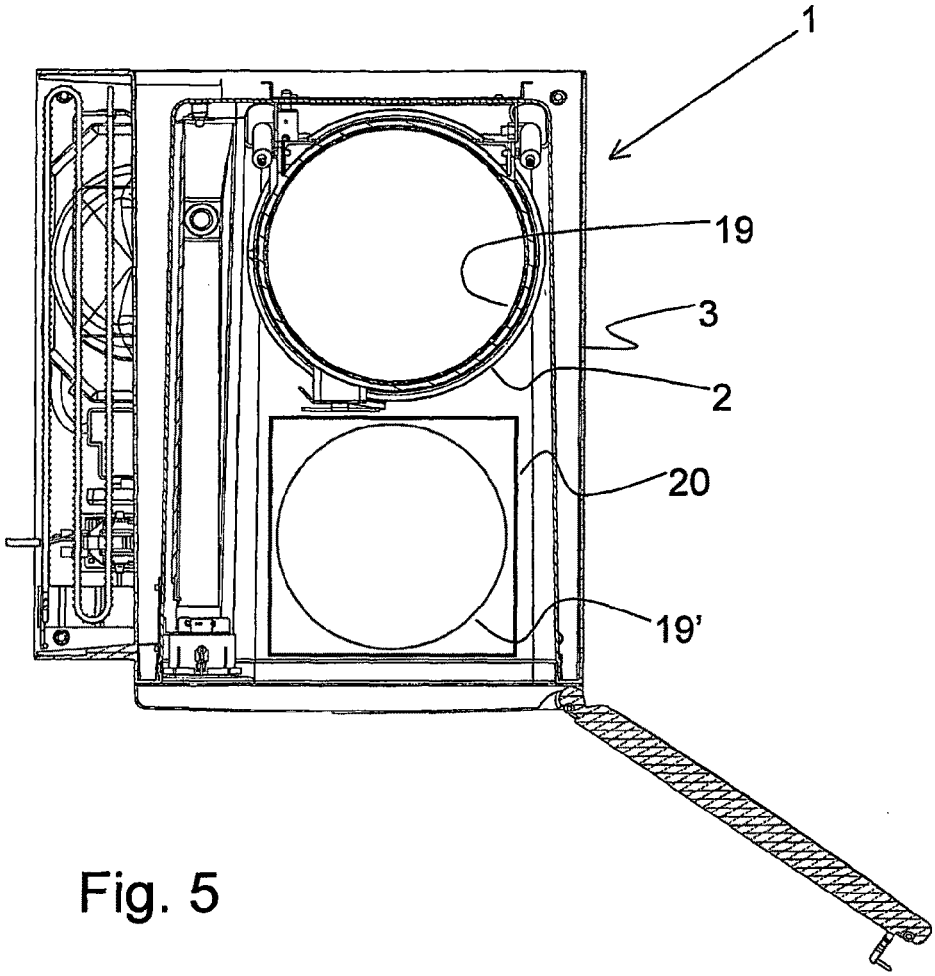
FIG. 5 shows in the same view as FIG. 4 an additional beverage container placed in the assembly.

FIG. 5 shows the additional beverage container 19' placed in a packaging box 20. Said packaging box 20 may be made of for instance, cardboard. In a preferred embodiment, the packaging box may comprise a bottom part, which is adapted to support the beverage container, and a top part, which is adapted to be removed from the bottom part. The top part may be removed before the beverage container and the bottom part is placed in the cooling unit for pre-cooling, thereby enabling that the packaging box does not function as isolation for the beverage container. Hereby the pre-cooling time of the beverage container is reduced considerably. The packaging box 20 will be described further below in connection with FIGS. 40-43.

In FIG. 6 the pressure chamber 2 is shown in a cross-sectional side view with a beverage container 19 placed in the pressure chamber 2. The beverage container 19 is placed upside-down and the pressure chamber is in this vertical position ready for use. The beverage container 19 comprises a connecting element 21 arranged at the outlet of the beverage container 19. The connecting element 21 is adapted to abut the lid 9 of the pressure chamber 2 (during use) and to align the opening 22 of the lid 9 with the inlet end of the dispensing line (not shown) as well as to connect the inlet end of the dispensing line to the outlet of the beverage container 19. The connecting element 21 will be explained in detail, in connection with the FIGS. 10-22.

Outside the pressure chamber 2 in the cooling unit (not shown) is supporting means 23 arranged for supporting and fixating the pressure chamber 2 to the cooling unit. The supporting means 23 may be attached to the back wall of the cooling unit at 24 and 25 of the supporting element 23. The supporting means 23 is in this embodiment shown as a lattice structure but may as well have other configurations and designs.

The supporting means 23 may be arranged on each side of the pressure chamber 2, and preferably the top end of the supporting means 23 is connected to the pivot means 11. The lower end of the supporting means 23 is connected to means 26, which enable pivoting of the pressure chamber 2 between two positions. The means 26 in this embodiment are gas cylinders, which at the one end connected to the supporting means 23 and at the other end to the pressure chamber. These means 26 facilitate the handling of the pressure chamber for the user when the pressure chamber is to be moved between the first position, i.e. the use position and the second position, the unloading/loading position. The gas cylinders 26 are also adapted to damp the speed of the pivoting, without which the means 26 may be too high due to the fact that the pressure chamber 2 has the rotation center at the end and that the pressure chamber 2 with a filled beverage container has a considerable inertia, which will be transferred to a high speed of rotation if the user or the means 26 is not damping it. The means 26 may also be spring means or hydraulic cylinders.

In FIG. 7 is shown the pressure chamber 2 in the second unloading/loading position. i.e. a horizontal position of the pressure chamber 2. In this position the gas cylinder 26 is shown in an extended position. The pressure chamber 2 may also comprise holding means (not shown) for fixating the pressure chamber 2 in the first position and the second position, respectively. When the pressure chamber 2 is at the second position, pressure releasing means (not shown) is arranged for releasing the pressure from the pressure chamber 2 thereby enabling that the lid 9 of the pressure chamber 2 may securely be removed.

Figure 8:
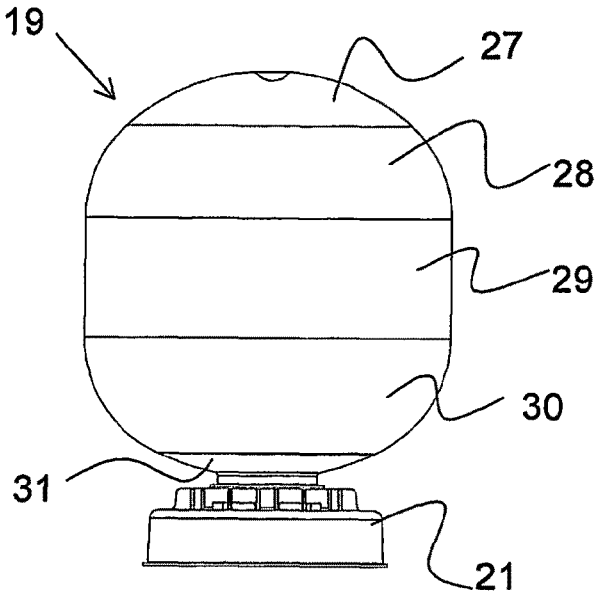
FIG. 8 shows in a side view a first embodiment of a beverage container.

In FIG. 8 is a 5-liter beverage container 19 according to the invention shown. At the outlet end of the beverage container 19 the connection element 21 is arranged. This 5 liter beverage container 19 may be used in connection with the assembly 1' shown in FIGS. 2 and 3.

The beverage container 19 is preferably manufactured from plastic, particularly a polymer, such as PEN or PET, preferably, blended PET. Thus, the beverage container 19 can be formed as a thin-walled, self-supporting structure that is suitable for collapsing when an external pressure is applied to the pressure chamber. The beverage container 19 can be manufactured as a multilayer construction comprising an oxygen barrier for preserving the beverage content of the beverage container. Furthermore, the beverage container 19 can be tinted or dyed to create a barrier to light, in case the beverage quality is sensible to light. Such a light barrier could be placed in the oxygen barrier. Other suitable processes are coating the beverage container 19, e.g. plasma coating the interior surface and/or epoxy-coating the exterior surface. The beverage container 19 preferably comprises five parts. A first part 27 which is the curved bottom of the beverage container 19; a curved second part 28: a third middle part 29, which preferably is not curved; a curved fourth shoulder part 30 and a fifth neck part 31 having the outlet opening.

Figure 9:
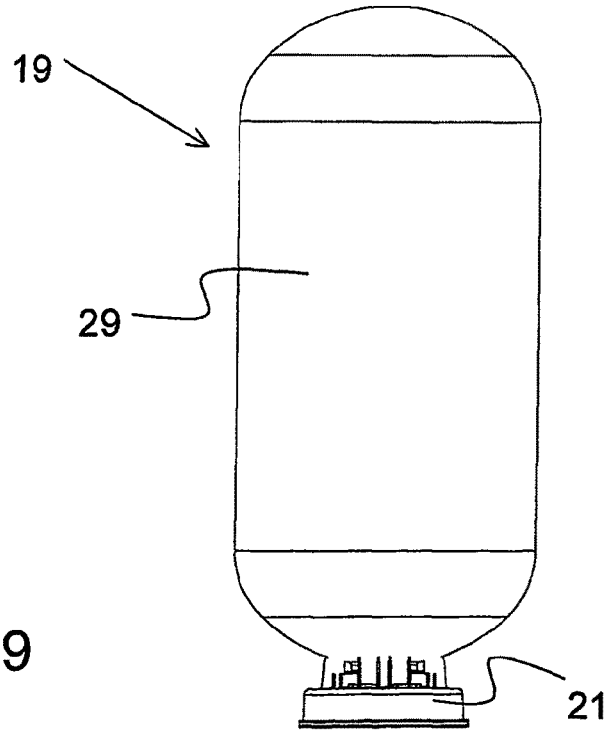
FIG. 9 shows in a side view a second embodiment of a beverage container.

In FIG. 9 is another size of the beverage container 19 shown in a smaller scale than the one used in FIG. 8. This beverage container 19 may contain 20 liter and may be used in the assembly 1 shown in FIG. 1. The difference between the beverage container shown in FIG. 8 and the one shown in FIG. 9 is that the third middle part 29 has a longer extension in the beverage container shown in FIG. 9, whereby the larger volume of the container is obtained. Preferably the other parts are identical so that all elements used in connection with the beverage containers as well as the assembly are standardized, which facilitates the manufacturing and handling of the specific elements of the assembly. A further advantage is that the 5-liter beverage container may be used in the assembly 1 shown in FIG. 1 when for instance a manufacturer of beverage is introducing a new beverage and the consumer first will want a taste of the new beverage before placing a bigger order at the manufacturer.

The beverage containers 19 can be transported separately to the site of filling. Usually such beverage containers 19 are not blown to their full size until immediately before their filling with beverage. At the production site the beverage containers 19 are blown to their full size, the container 19 having a bottom part, a middle part with a generally cylindrical wall, a shoulder part and a neck part constituting an inlet and outlet. After blowing the beverage container 19 into shape the container 19 is filled with the desired beverage and closed by pressing the connecting element 21 over the neck. Thus, the connecting element 21 functions as capsule.

Figure 11:
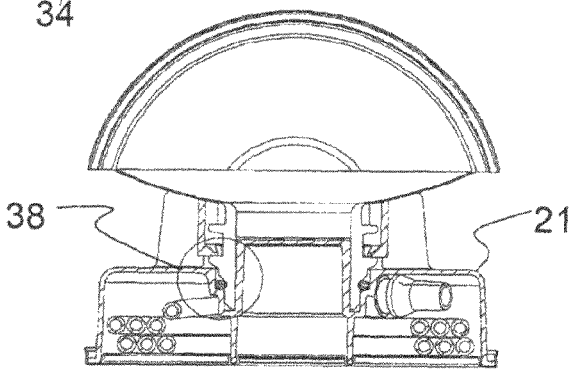
FIG. 11 shows a sectional view of a connecting element with a coiled up dispensing line.
Figure 13:
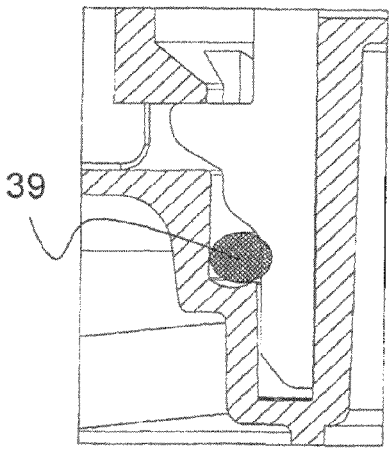
FIG. 13 shows an enlarged sectional view of the encircled area in FIG. 11 and illustrates the placement of a sealing device between the beverage container and the connecting element.

Preferably, the connection between the connecting element 21 and the beverage container 19 is of such a nature that once the connecting element 21 has been secured to the beverage container 19 it cannot be removed without damaging the beverage container 19 and/or the connecting element 21, thus providing a tamperproof container unit containing beverage ready to be delivered to the place of consumption. Such an inseparable connection can be obtained in a variety of ways. Preferably the connection is obtained by press fitting the connecting element 21 over the neck of the beverage container 19, the neck and connecting element 21 being provided with cooperating locking means, e.g. in the shape of taps/barbs and recesses/collars as indicated in FIGS. 11 and 13 or any other kind of snap mechanism. Alternatively, the connecting element 21 can be glued or welded to the neck of the beverage container 19, or the connecting element 21 could be screwed onto the neck of the beverage container 19, provided the thread is equipped with means for preventing release of the connecting element 21.

A number of different factors and circumstances, all the way from the filling of beverage containers to the dispensing of the beverage, may play significant roles in relation to the taste of the dispensed beverage. Considering as an example beer, the filling procedure may play a role in the taste of the dispensed beverage. Preferably, the kegs are supplied to the filling site as preforms of a polymer material as described above. These pre-forms are transformed into finished kegs by expansion with air pressure at the filling site. The kegs are disposable, meaning that they are only used once and not cleaned and re-used like regular beer kegs. Thus, not only are the kegs new (i.e. never been used before) when being filled, they have also been made into their final form at the filling site and under the same highly hygienic and controlled conditions that apply to the filling process itself. This certainly adds to the chances of avoiding contamination of the kegs and the beverage, and thus increases the quality of the beer. The kegs are usually filled by use of a filling tube being inserted into the keg through the opening at the top of the keg. Beverage is then filled into the keg from the bottom thereby gradually displacing the air inside the keg as it fills up. Also the keg may be flushed with $CO_2$ before filling. When the keg has been filled, the connecting element is placed over the opening of the keg, thus sealing the keg. At this point virtually no air is left inside the keg. This is an advantage since excess air inside the keg may contribute to the deterioration of the taste and other properties of the beverage. By furthermore using an assembly that compresses the flexible polymer beverage container as it is being emptied, no outside air enters the container after it has been opened, thus further preventing deterioration of the beverage due to air. Furthermore, the material of the keg may play a very significant role in conserving the properties of the beverage. The exact material of which the keg is made can certainly influence the beverage, for instance by preventing or allowing diffusion of gasses through the keg, thereby influencing the level of various gasses inside the beverage, such as oxygen, carbondioxide and nitrogen. The diffusion or lack of diffusion of these gasses from or to the beer may affect the shelf-life, in opened or unopened form, of the keg. Other properties, such as the taste, aroma and foam formation may also be affected. It may furthermore be beneficial to the properties of the beverage to employ disposable dispensing lines and valves. By using disposable parts risks of contamination of the beverage by unclean assemblies are minimized. It may often be both time-consuming and difficult to clean beverage dispensing assemblies, including dispensing lines and valves, properly. Disposable dispensing lines and valves are thus a great help to the user of the assembly and also ensures the customers against ill-kept assemblies and the resulting low quality beverage.

Figure 10:
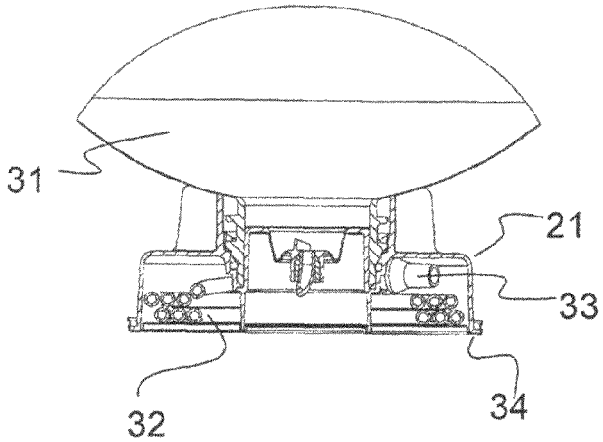
FIG. 10 shows a sectional view of a connecting element with a coiled up dispensing line.
Figure 12:
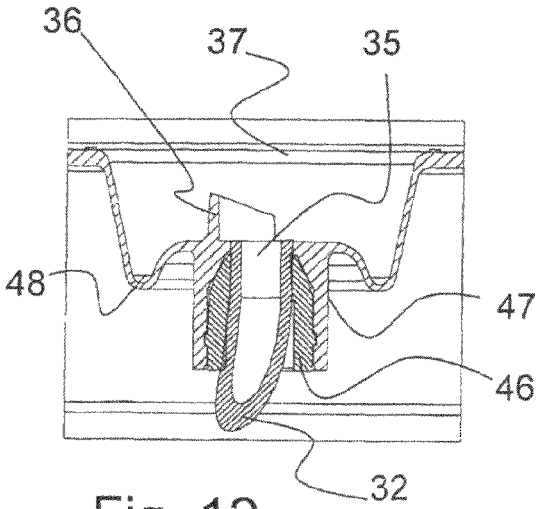
FIG. 12 shows in a detailed sectional view the inlet end of the dispensing placed in the connecting element and a piercer.

In FIG. 10 the connecting element 21 is shown in a cross-sectional side view connected to the neck part 31 of the beverage container. In this embodiment the dispensing line 32 is shown coiled up and placed inside the connecting element 21. In connection with the dispensing line a dispensing valve 33 is arranged. Over the bottom of the connection element 21 a cover 34 is arranged for protecting the dispensing line during transportation. FIG. 12 is an enlarged area of the connecting element 21 of FIG. 10 showing that the inlet end 35 of the dispensing line 32 is arranged in the connection element 21 at the piercer 36. The piercer 36 is adapted to pierce a membrane 37 during use thereby providing a fluid communication between the outlet of the beverage container and the inlet 35 of the dispensing line 32. Around the inlet end 35 of the dispensing line 32 an adaptor part 46 is arranged which is adapted to fit into corresponding receiving means 47 of the connecting element 21 thereby attaching the dispensing line 32 to the connecting element. Preferably, the connection is carried out by a press fining. The receiving means 47 and the piercer 36 are arranged on a flexible collar 48.

FIG. 11 also shows the connecting element 21 in a cross-sectional side view. The encircled area 38 is shown enlarged in FIG. 13 and illustrates in detail the connection between the neck of the beverage container and the connecting element. Between the beverage container and the connecting element a sealing ring 39 is arranged. The sealing ring 39 avoids any leakage of beverage during normal use as well as sealing of when mutual displacement of the beverage container and the connecting element occur.

Figure 14:
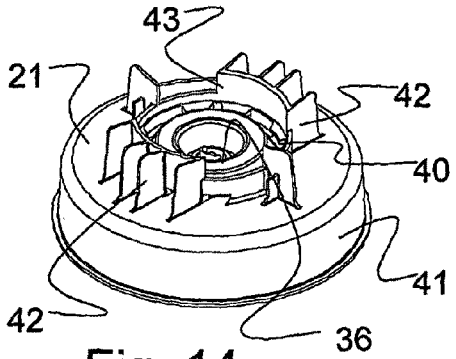
FIG. 14 shows in perspective the top side of the connecting element.

In FIG. 14 the connecting element 21 is shown in perspective from above. The connecting element 21 comprises a housing 41, a piercable closure, i.e. a membrane (not shown) for sealing the beverage container, locking means 40 (c.f. FIG. 13) for inseparably and hermetically connecting the connecting element 21 to the neck part of the beverage container, sealing means (not shown, however, is illustrated in FIG. 13) for hermetically sealing the beverage container to the connecting element 21 and a hollow piercer 36 adapted for piercing the piercable closure.

Figure 49:
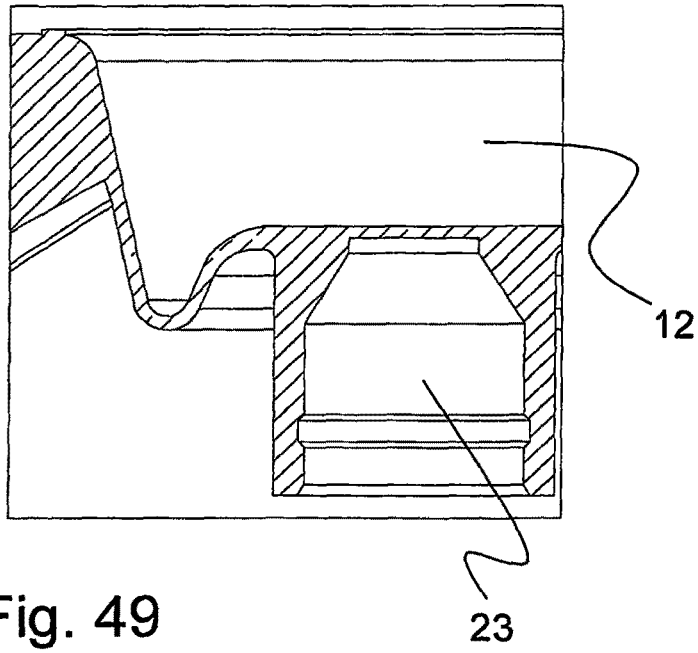
FIG. 49 shows a sectional view of part of a particular embodiment of a connecting element.

Additionally, a second membrane may be arranged as a part of the connecting element 21. This membrane may be made of a polymer material, such as PET, and may be an integral part of the connecting element 21. The second membrane may preferably be arranged outside the first membrane in relation to the inside of the beverage container, and may thus be the first membrane to be penetrated by the piercer. The piercer may optionally be adapted specifically for interaction with such a second membrane. For instance, the piercer may be made of metal in order to secure proper penetration of the membranes. FIG. 49 shows a sectional view of a part of a connecting element 21. In FIG. 49 the part of the piercer pointing towards the membranes and the beverage container is shown as being flat. This may be an advantageous form for a metal piercer.

Furthermore, ribs 42 are arranged around a peripheral wall 43, said wall 43 being adapted to bear the locking means 40 and abuts the outside of the neck of the beverage container when said container is connected to the connecting element 21. The ribs 42 support the wall 43 and thereby the neck of the beverage container and secure a rigid engagement between the connection element 21 and the neck of the beverage container. It should be mentioned that when the connecting element 21 is mounted on the beverage container, the connecting element 21 is being used as a handle, thereby facilitating the handling of the cylindrical beverage container for the user. Therefore, it is of major importance that the engagement between the beverage container and the connecting element is as rigid as possible. Said ribs 42 may furthermore, extend up to the shoulder of the beverage container for supporting this.

Figure 15:
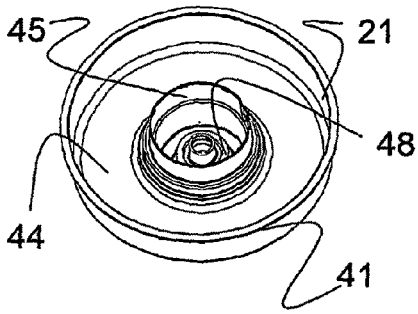
FIG. 15 shows in perspective the bottom side of the connecting element.

In FIG. 15, the connecting element 21 is shown in perspective from below. The housing 41 provides an annular room wherein the dispensing line may be stored in a coiled up state as shown in FIGS. 10 and 11. Near the center of the connecting element 21 is an annular wall 45 arranged for protecting the connection between the dispensing line and the connecting element 21. The wall 45 also protects the collar 48.

Figure 16:
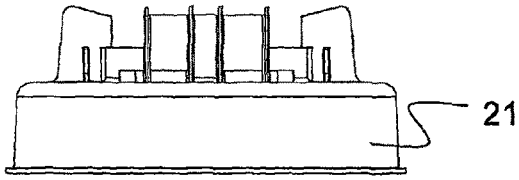
FIG. 16 shows in a side view the connecting element.
Figure 17:
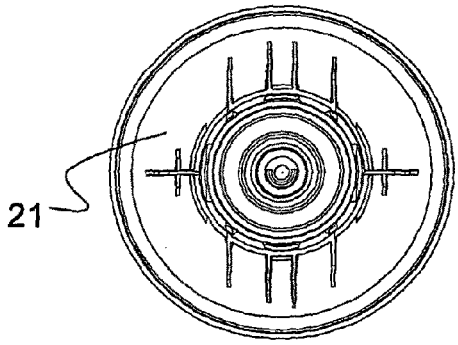
FIG. 17 shows in a top view the connecting element.
Figure 18:
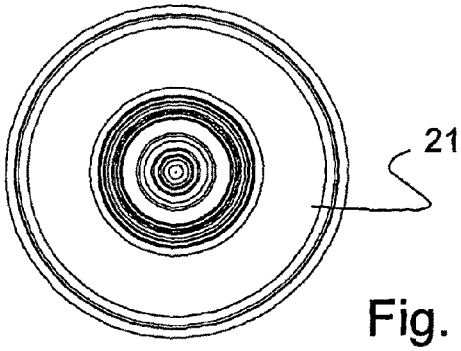
FIG. 18 shows in a bottom view the connecting element.

FIGS. 16-18 show the connecting element 21 in a side view, a top view and a bottom view, respectively.

Figure 19:
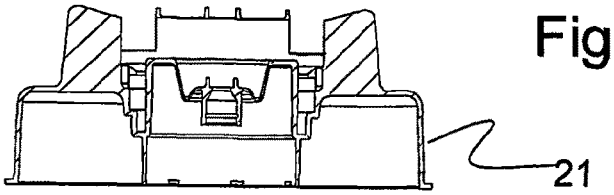
FIG. 19 shows a first side sectional view of the connecting element.
Figure 20:
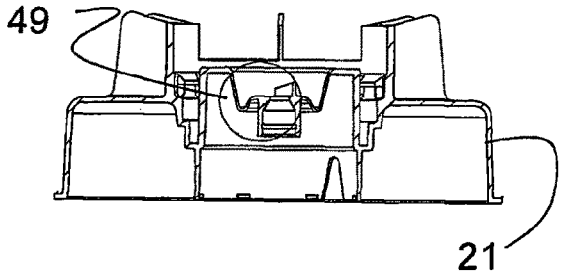
FIG. 20 shows a second side sectional view of the connecting element.
Figure 21:
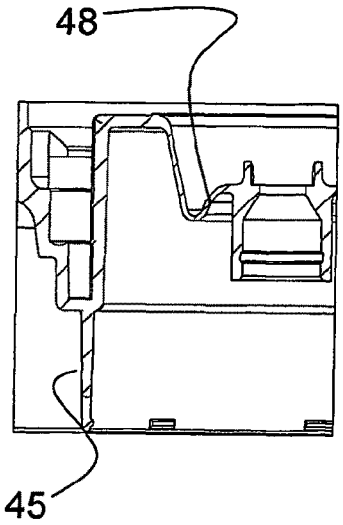
FIG. 21 shows an enlarged detailed sectional view of a part of the connecting element.
Figure 22:
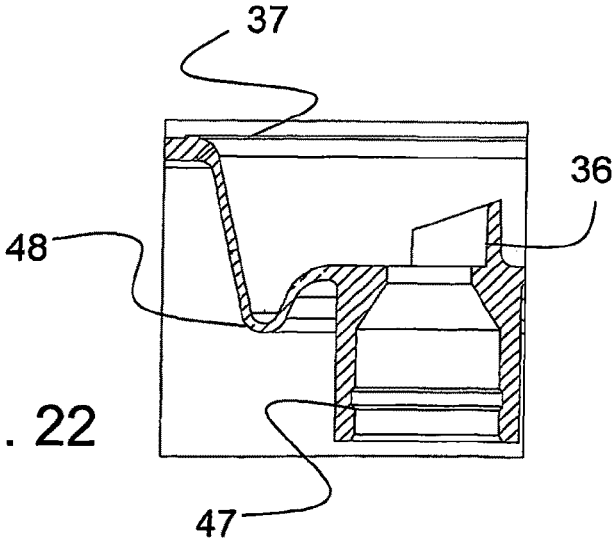
FIG. 22 shows an enlarged sectional view of the encircled area in FIG. 20.

FIGS. 19-20 show different cross-sectional side views of the connecting element 21. FIG. 21 shows a detailed area of the collar 48 and the wall 45 of FIG. 19. The encircled area 49 in FIG. 20 is shown enlarged in FIG. 22 and again show in detail the receiving means 47, the piercer 36 arranged for piercing of the membrane 37 and the flexible collar 48.

Preferably the hollow piercer 36 has means for abutment on the lid, while the lid has corresponding abutment means. This allows the piercer 36 to open the beverage container by piercing the sealed outlet automatically when the beverage container is forced downwards towards the lid of the pressure chamber, since the abutment with the lid forces the piercer 36 to move relative to the connecting element 21. The need to manually handle the opening of the beverage container before placing the beverage container in the assembly 1, 1' is thus avoided. The piercer 36 in the shown embodiment is made as an integrated part of the connecting element 21. The piercer 36 is as described above provided with the collar 48. The collar 48 may be provided with one or more slits (not shown) and is preferably constructed in the same material as the other parts of the piercer 36. The slits of the collar 48 provide resiliency to the collar 48, and causes the collar 48 to flex outwards when the piercer 36 is forced towards the beverage container to pierce the membrane 37.

The parts of the connecting element 21 are preferably made in a plastic material such as PET, PE, PBT or PP. This allows for low construction costs, and further allows the parts to be grinded and recycled for new plastics products, e.g. new connecting elements. The seals can be glued to the connecting element. The material for these seals/membranes can e.g. be a plastics, a plastics coated paper, paper, aluminum foil.

Furthermore, the structure of the connecting element 21 adapted for cooperation with the lid of the pressure chamber, allows the beverage container when said connecting element being mounted on the neck of the beverage container to stand upright with the outlet of the container facing downwards. The connecting element 21 allows the beverage container to stand on the lid as well as on any other surface without any risk of damaging the outlet of the beverage container, since the outer wall of the connecting element extends beyond the neck part of the beverage container.

Additionally, this leaves the upper end of the generally cylindrical collapsible beverage container opposing the outlet end to be shaped in a manner for optimal collapsing performance.

The substantially flat connecting element 21 simplifies the installation of the beverage container in the pressure chamber considerably, since the beverage container need not be maneuvered over the walls of the dispensing assembly as is the case with the prior art assemblies. Thereby the structure allows for easy placement of even large beverage containers.

In another not shown embodiment the hollow piercer may be omitted and be replaced by an obliquely cut inlet end of the dispensing line. The matter could be that the inlet end of the dispensing line extends through the adaptor part 46, so that when the dispensing line is connected to the connecting element 21 at the receiving means 47, obliquely cut dispensing line end will also extend up through the collar 48 and end at a predetermined distance from the membrane 37 to be pierced.

Furthermore, spring means may be arranged inside the pressure chamber for facilitating the piercing of the membrane.

FIGS. 23 and 24 show the adaptor part 46 in a side view and a cross-sectional side view, respectively. The outer surface of the adaptor part 46 comprises an annular projection 50, which is adapted to engage with a corresponding annular groove in the receiving means 47 so that a lock between the adaptor part and the receiving means is obtained. It should be mentioned that the lock is of such a nature that the adaptor part may be removed from the receiving means again by using a predetermined force.

FIGS. 25 and 26 show the dispensing valve 33 in a perspective side view and a cross-sectional side view, respectively. In FIG. 26 the outlet end of the dispensing line 32 is shown placed in the valve 33 by using the same means for connection as in the inlet end of the dispensing line, i.e. an adaptor part 46 and corresponding receiving means 47 in the valve 33. The connection between the dispensing line and the valve may be a click attachment so that easy interchange of the valve is obtained. The dispensing valve 33 may be a standard in-line valve and may be interchangeable.

Figure 50:
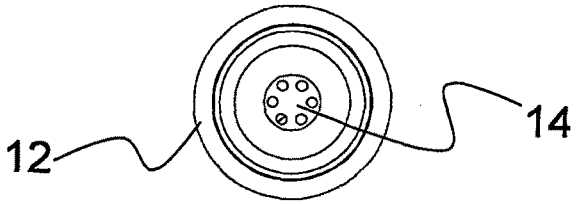
FIG. 50 shows a sectional view of an embodiment of a dispensing valve wherein the interaction means is an integral part.

The interchangeable dispensing valve may be arranged at a downstream end of the dispensing line and may be arranged in connection with interaction means (not shown), said interaction means being adapted for affecting a specific kind of beverage being dispensed, so as to achieve a beverage-specific dispensing. FIG. 50 shows a sectional view of an embodiment of an interchangeable dispensing valve wherein the interaction means is an integral part. The valve is seen from one end and the interaction means can be seen inside the valve. In this particular embodiment the interaction means is constructed by making apertures in an integral part, e.g. a small plate, of the valve. Beverage flowing through the valve thus also passes through these apertures. Having the interaction means as an integral part of the valve has the advantage that the interaction means is automatically supplied and removed along with the interchangeable valve. Thus, there is no risk of dropping or loosing the interaction means in the process of changing the valve, and an old, and possibly contaminated, interaction means is never mistakenly reused as part of the assembly 1 when the valve is changed. Furthermore, when supplying the interchangeable valve along with, or possibly connected to, a beverage container, e.g. a beer keg, the right kind of interaction means to fit the beverage can always be supplied, thus making changes between different beverages easy and safe for the user. Additionally, constructing the interaction means as an integral part of the valve eliminates the separate production of the interaction means and thus makes production both easier and less expensive.

Figure 27:
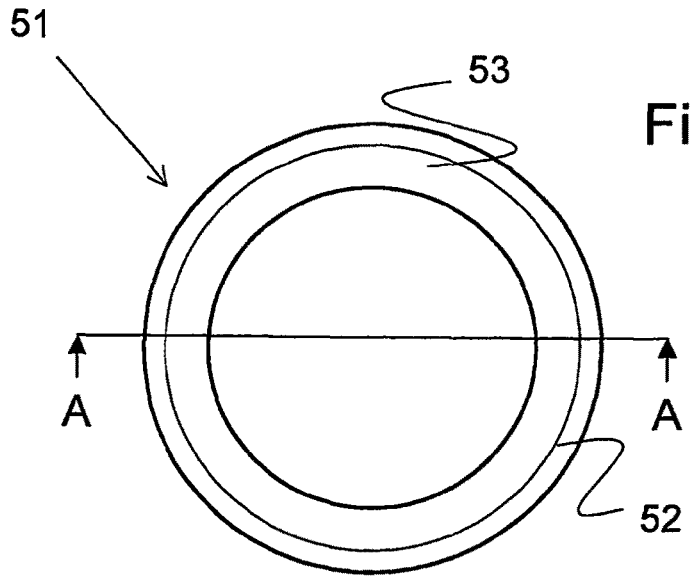
FIG. 27 shows a sealing element in a top view.
Figure 28:
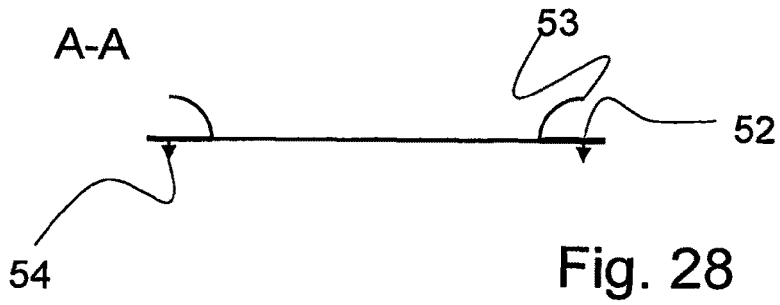
FIG. 28 shows a cross-sectional view of the sealing element shown in FIG. 27.

FIGS. 27 and 28 show a sealing element 51 in a top view and a cross-sectional side view taken by the line AA in FIG. 27, respectively. 45. The sealing element 51 is arranged at the inside of the lid 9 and the connecting element 21 during use.

The sealing element 51 is formed as a ring and comprises a main part 52, an annular lip 53 and a plurality of taps 54 placed around the main part 53 with a mutual spacing on the opposite side of the lip 53. During use of the assembly when the beverage container has been loaded into the pressure chamber and the pressure chamber is placed in the use position, i.e. the vertical position the beverage container, placed in upside down position will start to move downwards against the lid of the pressure chamber. The connection element 21 will during this movement first come into contact with the lip 53 of the sealing element 51, whereby a sealing is obtained and a pressure may be built up. The connection element 21 continues its movement towards the lid and will thereby push the lip 53 down towards main part 52 of the sealing element 51. As the pressure builds up in the pressure chamber the connecting element will be forced towards the lid and the sealing element 51 will provide a proper sealing between the lid and connecting element. Furthermore, due to the design of the sealing element 51, the sealing element 51 will easily release from the connecting element when the beverage container is removed from the pressure chamber. In addition, the sealing element may also have other geometrical configurations and designs such as being circular (e.g. an O-ring), square, elliptic, or any combination thereof, and being made of a material, which facilitates sealing such as rubber materials.

Figure 29:
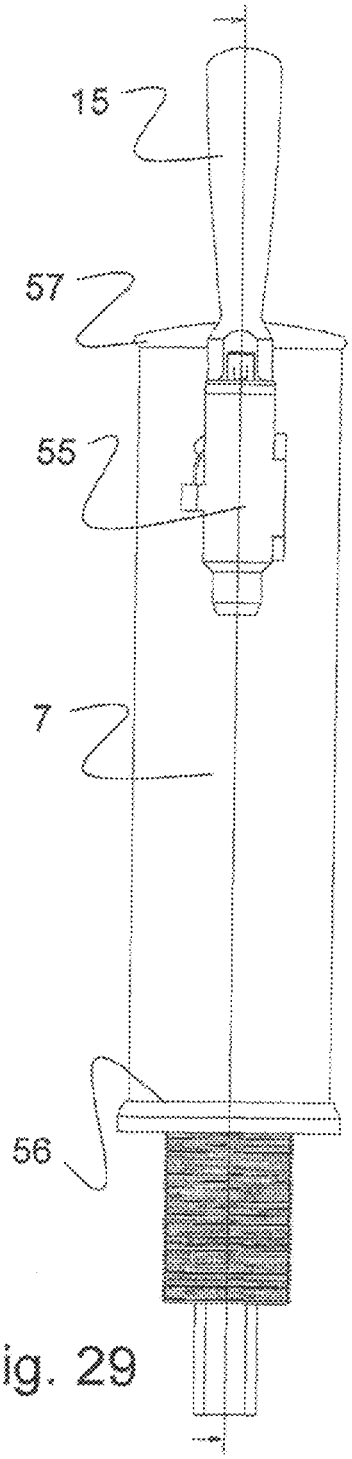
FIG. 29 shows a tower with a dispensing tap and a tap actuator.
Figure 30:
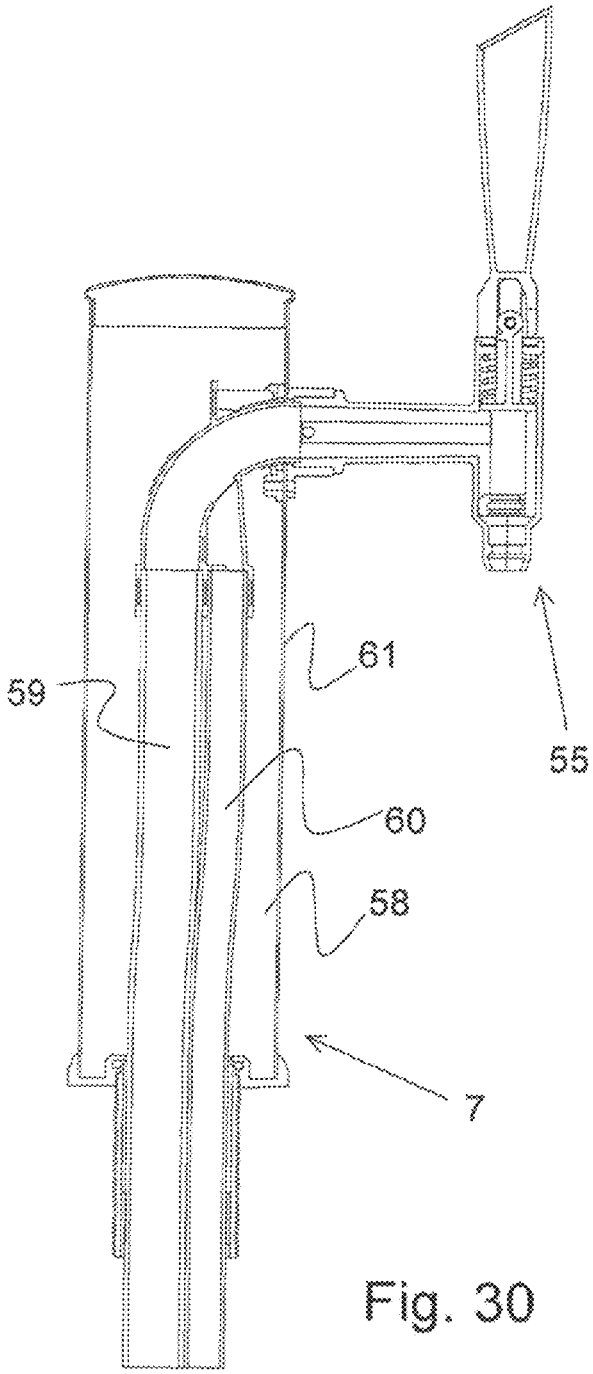
FIG. 30 shows a side cross-sectional view of the tower shown in FIG. 29, FIGS. 31-39 are a sequence of drawings showing the steps of preparing one embodiment of the assembly according to the invention for dispensing.

FIG. 29 shows an embodiment of a tower 7 comprising a dispensing tap 55, a tap actuator 15, a first end 56, and a second end 57. FIG. 30 shows a cross-sectional side view of the tower 7 of FIG. 29. The tower 7 comprises a first channel 58, a second channel 59, and a third channel 60. The walls of the channels 58-60 may be made of various materials or combinations of materials, such as metal, plastic or rubber. The outer walls of the first channel 58 may wholly or partially be the walls of the tower 7 as illustrated in FIG. 30. The second channel 59 and the third channel 60 are illustrated as extending out of the tower 7 at its first end 56. The second and third channels 59 and 60 are arranged within the first channel 58. The second and third channels 59 and 60 may either, as shown, be juxtaposed, or arranged in some other manner, such as with the second channel 59 arranged wholly or partially inside the third channel 60. The first channel 58 may comprise isolation material (not shown) such as a gas, foam, or heat reflective material for isolating the second and third channels 59 and 60.

By providing a tower 7 having an outer wall 61 defining an inside first channel 58 between the first end 56 and the second end 57 of the tower 7, where at least the two channels, 59, 60 are arranged in said first channel 58: the second channel 59 is arranged for accommodating the dispensing line (not shown), and the third channel 60 which is in fluid communication with said second channel 59 at the second end 57 of the tower 7 an efficient maintaining of cooling of the dispensing line in the tower is obtained.

The second channel and the third channel may extend a distance from the first end of the tower 7 to the cooling unit and said channels may be isolated along this distance. This may improve maintaining of cooling and minimize energy loss, especially in systems with long dispensing lines.

The cooling system may comprise means for maintaining cooling of the dispensing line, such as by gas, liquid cooling and may comprise means for ventilation, such as a mechanical ventilator, for ventilating cool air through at least the second channel. Such ventilation means provide for easy circulation of air. Advantageously, cool air may be ventilated through the second channel in a direction opposite to a flow direction of beverage in the dispensing line. Such counterflow of cool air provides for a very efficient cooling and ensures that the end of the dispensing line near the tap actuator is well cooled and thereby the beverage contained in the dispensing line is maintained cool.

In another not shown embodiment the third channel may be omitted and the second channel may be arranged for heat-conduction cooling of the dispensing line. The sec- and channel may comprise a mesh or net of wires of a heat conductive material. Such a mesh or net is a simple and effective manner to provide heat-conductive cooling.

Figure 38:
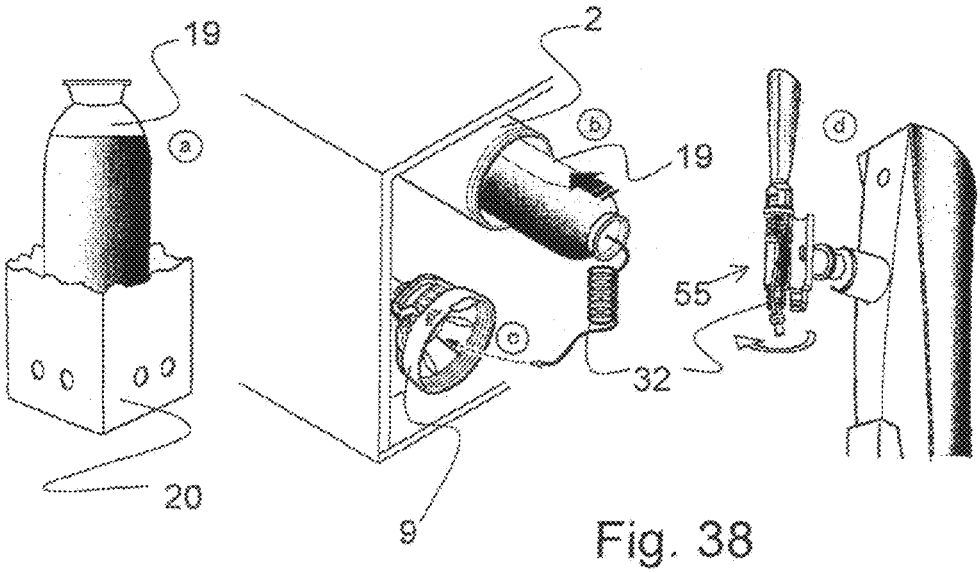
Figure 39:
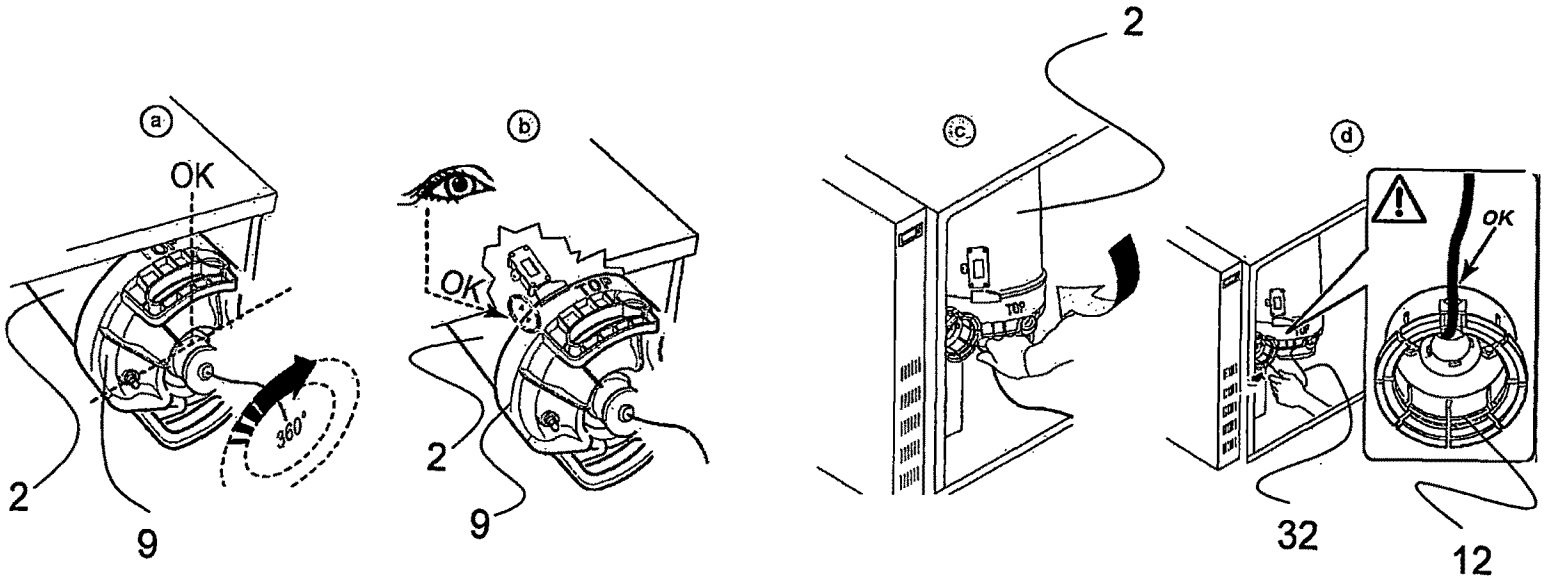

In the following sequence of drawings showing the steps of preparing one embodiment of the assembly 1 according to the invention for dispensing will be described. More specifically, FIGS. 31 to 37 show the sequence of steps carried out to remove a used and thereby collapsed beverage container from the assembly 1 and FIGS. 38 and 39 show the loading and installing of a new beverage container in the assembly 1.

Figure 31:
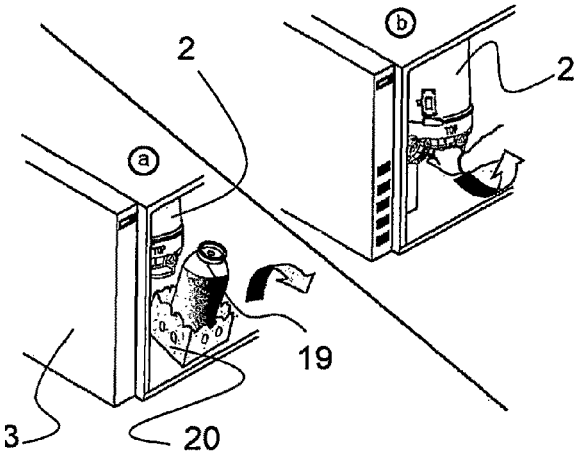

FIG. 31 shows step (a) wherein the cooling unit 3 is open, and it shows the removal of the packaging box 20 containing a pre-cooled beverage container 19 to allow access to the pressure chamber 2. FIG. 31 shows step (b) wherein the pressure chamber 2 is brought from a vertical operating position to a horizontal loading position by gripping the handle 10 of the lid and pulling it outwards and upwards defining a slowly rotating motion due to the cylinders as explained in connection with FIGS. 6 and 7.

Figure 32:
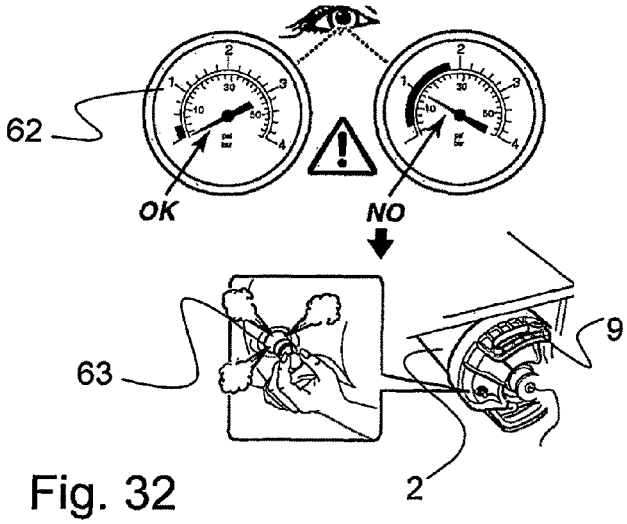

FIG. 32 shows a pressure gauge 62 indicating the state of pressure and no pressure present in the pressure chamber 2. FIG. 32 further shows the release of pressure through a pressure valve 63 on the lid 9 of the pressure chamber 2. The pressure system is controlled automatically, however, for safety and monitoring reasons it is provided with the pressure gauge 62 as shown in FIG. 32 in connection with the pressure chamber 2. If there is still a pressure in the pressure chamber 2, manual release can be carried out by opening of the safety valve 63 as illustrated in FIG. 32.

Figure 33:
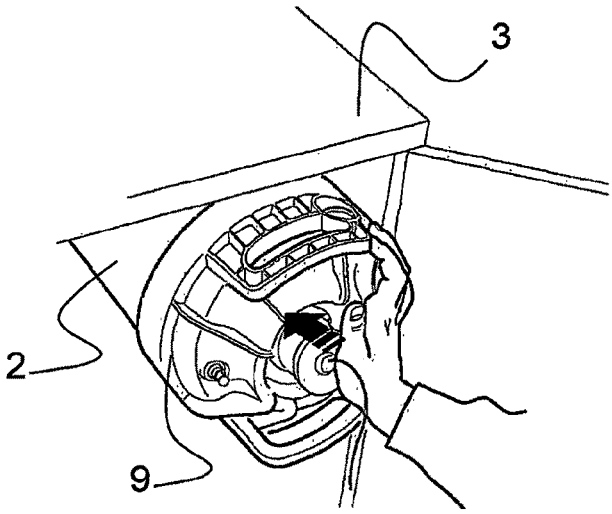

FIG. 33 shows the lid 9 of the pressure chamber 2 and illustrates the application of a slight pressure to the lid 9 to release the connecting element of the beverage container (not shown) inside the pressure chamber 2 from the lid 9. It is furthermore easily deduced that the pressure chamber 2 is placed at the top of the cooling unit 3 thereby providing ergonomic working conditions for the user.

Figure 34:
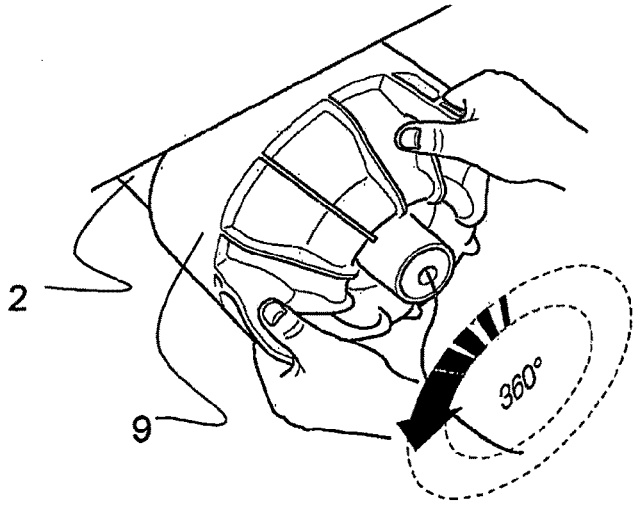

FIG. 34 shows the lid 9 of the pressure chamber 2 and illustrates the unlocking and releasing of the lid 9 from the pressure chamber 2. In a preferred embodiment of the invention the lid 9 is rotated counter clockwise 360 degrees as shown in the figure.

Figure 35:
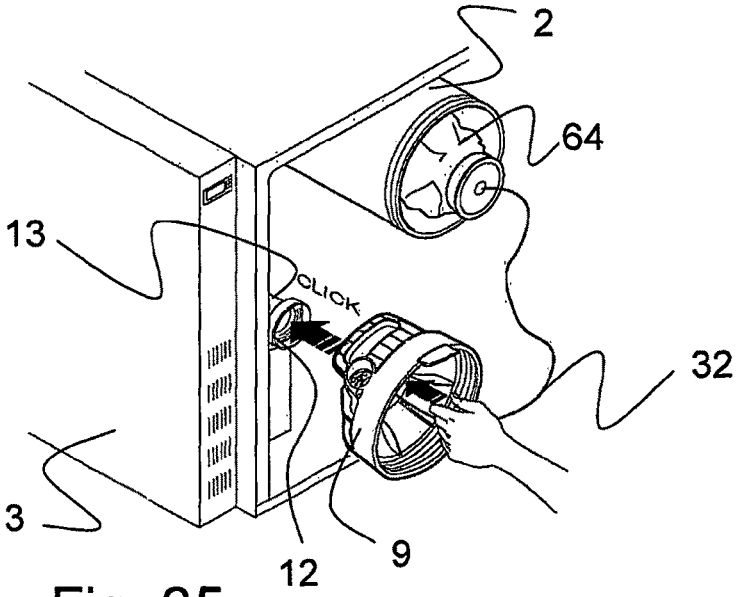

FIG. 35 shows the cooling unit 3, pressure chamber 2 with a used and collapsed beverage container 64 inside, the dispensing line channel 13, the lid 9 and a dispensing line 32. The lid 9 has been detached from the pressure chamber 2 and is lead along the dispensing line 32 to the opening 12 of the dispensing line channel 13 where the opening (not shown) of the lid 9 is aligned to the opening 12 of the dispensing line channel 13. A slight pressure applied to the lid 9 activates a snap connection attaching the lid 9 to the dispensing line channel 13.

Figure 36:
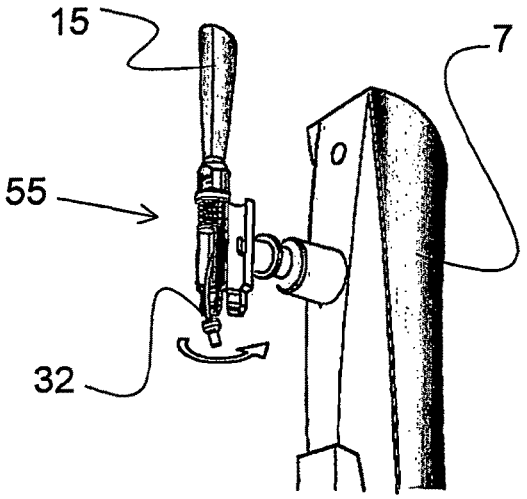

FIG. 36 shows a view of the tower 7 as shown in FIGS. 1, 29 and 30 with a dispensing tap 55, a tap actuator 15 and a dispensing line 32 where the dispensing line 32 is released from the dispensing tap 55 on the tower 7.

Figure 37:
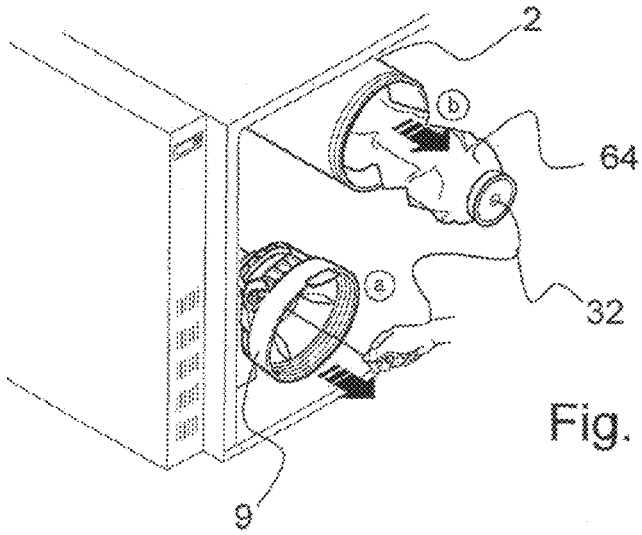

In FIG. 37, step (a), it is shown how the dispensing line 32 is retracted from the dispensing line channel by gently pulling it out through the opening of the lid 9. FIG. 37, step (b) then illustrates how the used and collapsed beverage container 64 is easily removed from the pressure chamber 2. It is easily deduced from FIG. 37 that the beverage container 64 is substantially completely collapsed after use. The collapsed container 64 is therefore non-reusable and may be disposed.

FIG. 38 step a shows the release of a beverage container 19, preferably the pre-cooled one from FIG. 31, from its packaging box 20. The beverage container 19 is then inserted into the pressure chamber 2 as shown in FIG. 38 step b. In FIG. 38 step c the dispensing line 32 is guided through the lid 9 and further through the dispensing line channel. The dispensing line 32 emerges from the dispensing tap 55 and is locked into a dispensing position as shown in FIG. 38 step d.

Corresponding to FIG. 35 the lid 9 is lead from the alignment with the end 12 of the dispensing line channel 13 along the dispensing line 32 to the pressure chamber 2, closing the pressure chamber 2.

FIG. 39 step a illustrates the locking of the lid 9 to the pressure chamber 2 which is carried out by turning the lid 9 clock wise 360 degrees. The proper locking of the lid 9 is confirmed as shown in FIG. 39 step b, the pressure chamber 2 is then brought into position for operation, as shown in FIG. 39 step c. To prevent clamping or squeezing, the dispensing line 32 is attached, preferably to the connection means 12 of the dispensing line channel as shown in FIG. 39 step d.

Figure 40:
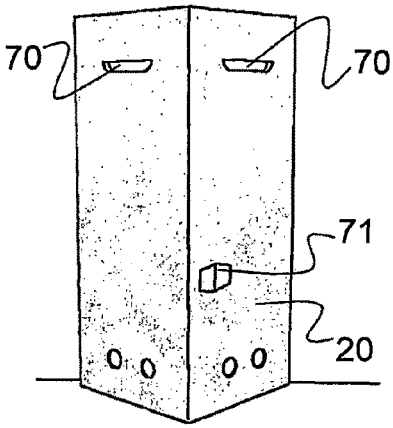
FIGS. 40-43 are a sequence of drawings showing the steps of preparing a filled beverage container for precooling in the cooling unit.
Figure 41:
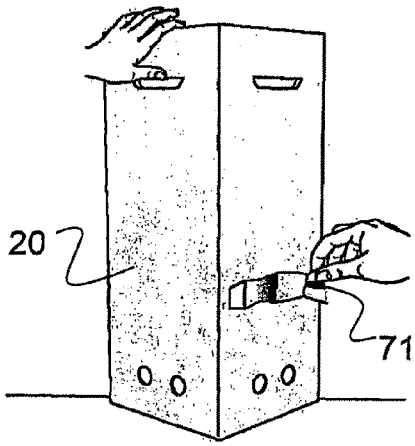

In FIG. 40 a packaging box 20 is shown. The packaging box 20 may be made of, for instance, cardboard and is adapted to house the filled beverage container during transportation and storage. At the top of the packaging box 20 handles 70 are arranged for easy handling of the box. At the lower part of the packaging box, means 71 for separating the top part from the bottom part are shown. In FIG. 41 is shown how the user is separating the parts by pulling a tear string around the circumference of the packaging box. Other separating means may be used such as for instance perforated areas, which ease the separation.

Figure 42:
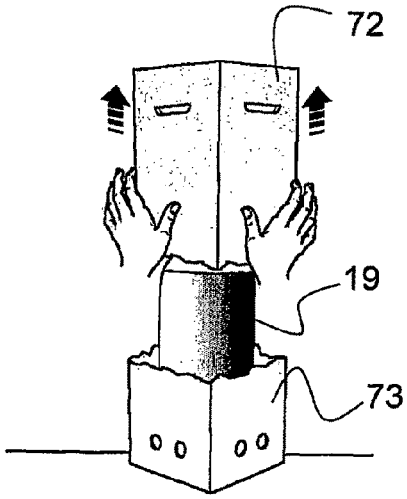

In FIG. 42 the top part 72 is being lifted up over the beverage container 19. The bottom part 73 is adapted to support the beverage container 19 so that the beverage container can be placed in an upright position without tilting or tipping over. The bottom part 73 is adapted to squeeze on the exterior of the beverage container so that the bottom part 73 not accidentally falls off when the beverage container is being moved without the top part.

Figure 43:
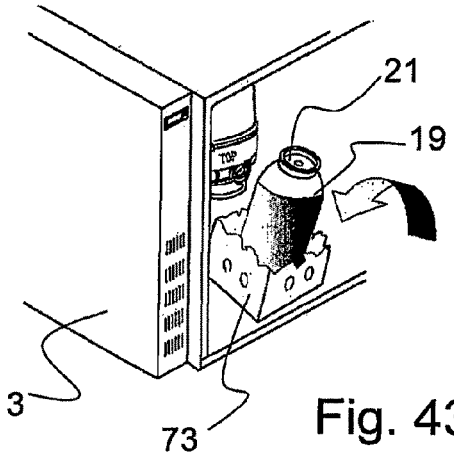

When top part 72 is removed the beverage container 19 with the bottom part 73 may be placed in the cooling unit 3 for pre-cooling as shown in FIG. 43. The handling of the beverage container 19 may be performed by using the connecting element 21 as a handle. By removing the top part of the packaging box it is avoided that the top part function as isolation for the beverage container. Hereby the pre-cooling time of the beverage container is reduced considerably. After the new beverage container 19 is placed in the cooling unit 3 for pre-cooling the door is closed and the assembly is ready for use.

Figure 44:
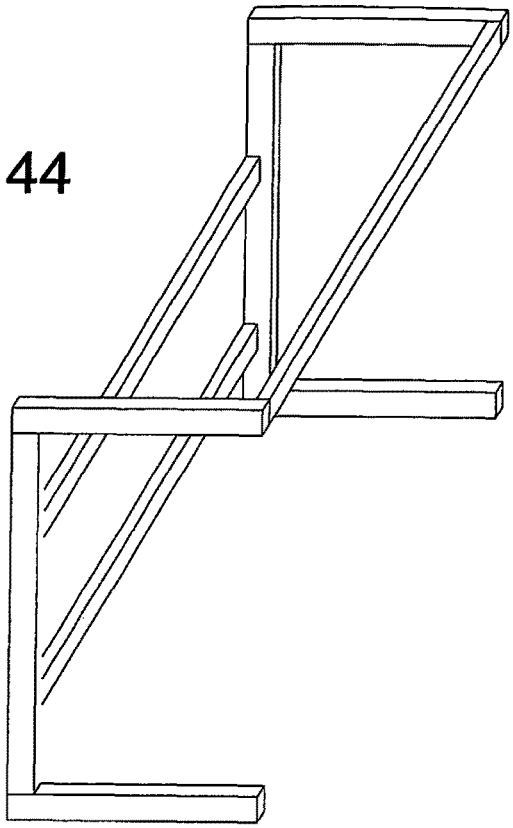
FIG. 44 shows a rack for accommodating a plurality of pressure chambers.
Figure 45:
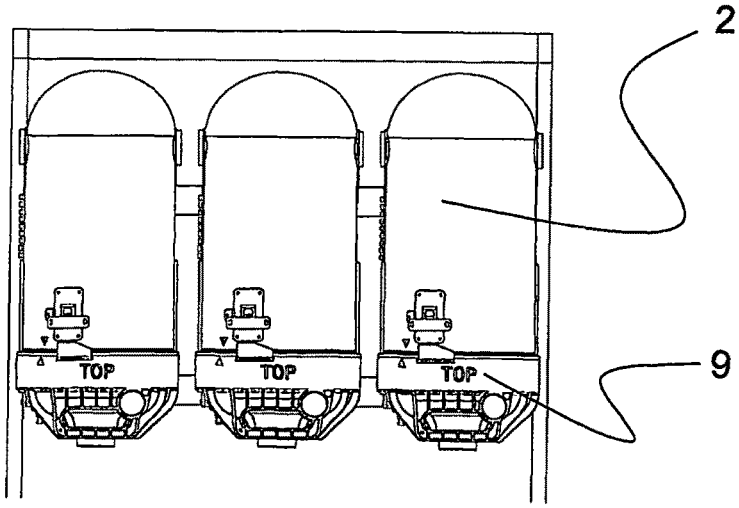
FIGS. 45-48 shows embodiments of units comprising a plurality of pressure chambers.
Figure 46:
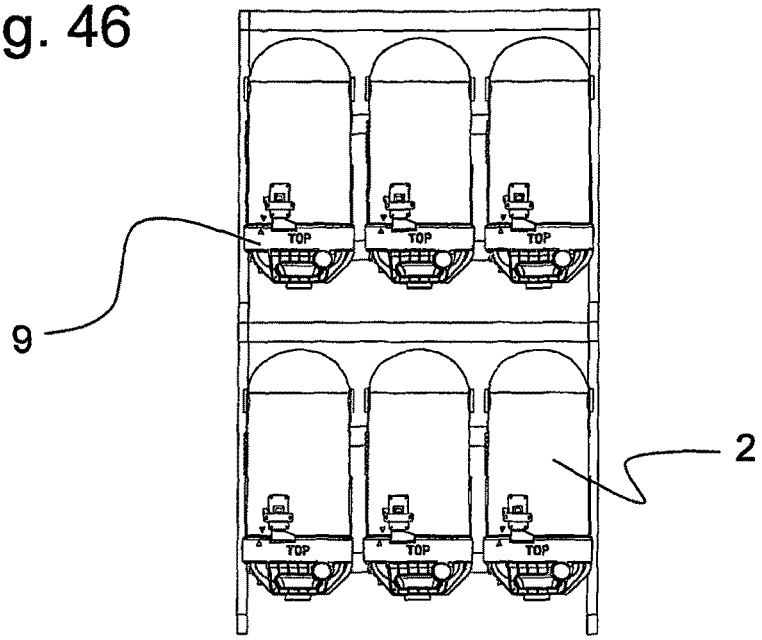
Figure 47:
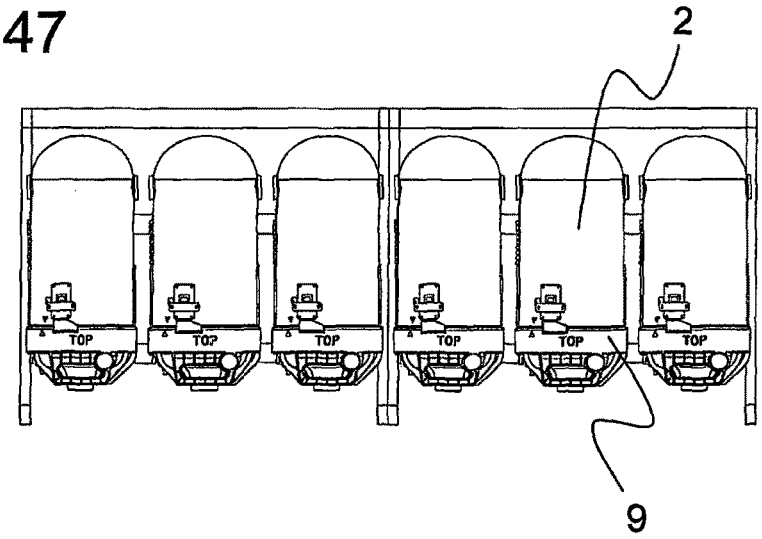
Figure 48:
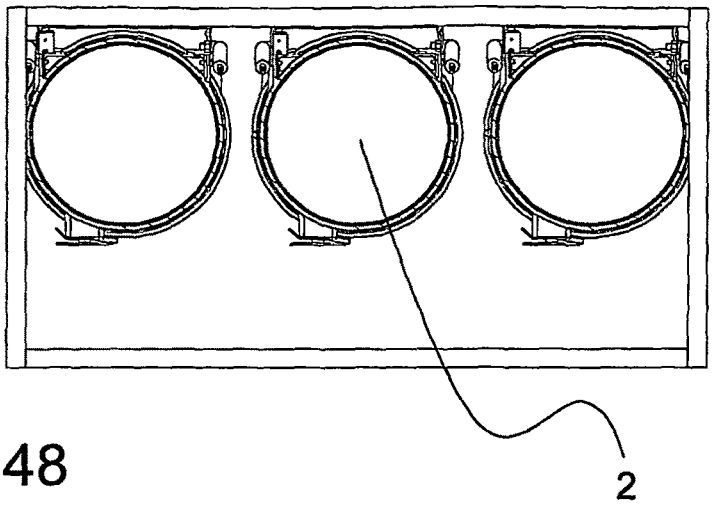

FIGS. 45-48 show different numbers of pressure chambers 2 arranged in common units. The pressure chambers 2 comprise lids 9 and may preferably be arranged on a rack, e.g. as shown in FIG. 44, or some other supporting means. Dispensing lines 32 connected to the beverage containers inside the pressure chambers may be led, optionally as a bundle, e.g. through one or more dispensing line 32 channels or guide tubes, to a number of dispensing taps. Alternatively, the pressure chambers 2 may be prepared for interaction with some existing beverage dispensing system. For instance, adapter means may be arranged in connection with the lids of the pressure chambers 2 in order to connect these to an existing system of beverage lines. Such adapter means may be of any shape and material necessary for connecting the pressure chamber, and hence the beverage container, to the dispensing line. In this manner several dispensing taps may be supplied with a number of different beverages from the same central unit of pressure chambers 2. The unit of pressure chambers 2 may preferably share a common cooling unit 3, for instance by being arranged inside a large cooling unit 3 or in some other sufficiently cold location, e.g. a cellar or large refrigerator. Furthermore, a unit comprising a plurality of pressure chambers 2 may also share a common pressure source.

According to an alternative embodiment (not shown) the dispensing line 32 is separated from the system and thereby has both of its ends free, allowing for free selection of the order in which the dispensing line 32 is connected to the dispensing tap 55 and beverage container 19 and guided through the lid 9 and the dispensing line channel 13. For instance, it could be that the dispensing line 32 is guided from the dispensing tap 55, through the dispensing line channel 13, through the opening of the lid 9 and to the beverage container 19 placed in the pressure chamber 2.

In an embodiment according to the invention a plurality of beverage containers may be arranged in the same pressure chamber. Hereby is obtained that the beverage containers may use the same pressure source and pressure for forcing the beverage out the beverage containers. Each beverage container may be connected to a dispensing line, which dispensing line is led to the dispensing tap as previously described. In this embodiment the plurality of dispensing lines are extending from the beverage containers through the lid and to the dispensing tap(s). Within the inventive idea the dispensing lines may be opened separately or they may be connected to the same dispensing tap and thereby being opened at the same time. In the latter case it is possible to dispense two separate beverages into the same glass so that a blended beverage is obtained.

Even though the methods and assembly as well as the drawings disclose a valve 33 connected to the outlet end of the dispensing line 32 and that said valve 33 is replaced with the dispensing line 32, it is within the inventive idea that the valve 33 also may be a separate valve which is not replaced at the same time as the dispensing line 32. Thus, the outlet end of the dispensing line 32 and the valve 33 may comprise complementary connection means, which may easily be separated, as shown in FIG. 26.

Furthermore, the outlet end of the dispensing line 32 (as well as the inlet end if not mounted in the beverage container) may comprise a cap, hood or cover (not shown) which may easily be removed after the guiding through the assembly 1, 1' and just before the dispensing line 32 is mounted in the valve 33 and beverage container 19, respectively. Hereby, it is obtained that the interior of the dispensing line 32 is kept clean and it is thereby avoided that the part, which comes in contact with the beverage, is contaminated.

The valve 33 (if placed at the dispensing line 33 before the guiding through the assembly 1, 1') may also comprise a cap, hood or cover for the same reasons as mentioned above.

Furthermore, the dispensing line 32 (not shown) may comprise at least two sections: a first section having a length $L_1$ and an inner cross-sectional area $A_1$, and a second section downstream of said first section, having a length $L_2$ and an inner cross-sectional area $A_2$, where $A_1$ is smaller than $A_2$. The matter is, that due to the smaller inner cross-sectional area $A_1$, the pressure of the beverage is reduced by passing through the first section. The second section with the larger cross-sectional area $A_2$ may ensure that the beverage obtains flow- and foam-formation properties suitable for dispensing. Such suitable flow- and foam-formation properties may depend upon the type of beverage being dispensed and may also be affected by other parts of an assembly for dispensing beverage. This embodiment of the dispensing line is especially expedient in connection with the assembly 1' of FIG. 2.

Thus, by applying and using the above described assemblies 1, 1' for dispensing beverage it is obtained:

- that the beverage contained in the beverage container may be dispensed without said beverage per se being supplied with or being in contact with any gas during the dispensing, so that the taste, texture and feeling of the beverage after dispensing are as intended from the manufacturer of the beverage;
- that the assembly is in balance, i.e. the exterior parameters that may influence the beverage are essentially eliminated to an imperceptible level;
- that the assembly is simple and flexible in construction as well as being easy to use and that it breaks with long established mindsets within the business both concerning the construction of the assemblies, the design, the logistics of the beverage containers as well as the maintenance and the service of the assemblies;
- that the beverage containers are not reusable, and therefore do not need to be transported back to the manufacturer of the beverage for cleaning and refilling, thus providing a huge advantage at areas where the consumption of beverage is low and where the distance to the nearest manufacturer is long;
- that the manufacturing of the assemblies is easy and inexpensive; and that loading and unloading of beverage containers in the pressure chamber is facilitated so that ergonomic working positions for the user is achieved.

Although the invention above has been described in connection with preferred embodiments of the invention, it will be evident for a person skilled in the art that several modifications are conceivable without departing from the invention as defined by the following claims.

The invention claimed is:

1. An assembly (1, 1') for dispensing a beverage, comprising:

a collapsible beverage container (19) having an exterior surface and an outlet;

a pressure chamber (2) configured to contain the beverage container (19) and to apply a pressure to the exterior surface of the beverage container (19) therein, the pressure chamber (2) having an open end;

a lid (9) removably fixed to the open end of the pressure chamber and having an inner surface and an opening (22);

a dispensing line (32) having an inlet end (35), the dispensing line (32) extending through the opening (22) in the lid (9) to a dispensing tap (55); and a connecting element (21) fixed to the exterior surface of the beverage container (19) circumferentially around the outlet of the beverage container (19) and configured (a) to engage with the inner surface of the lid (9) so as to fix the lid (9) to the beverage container (19) with the opening (22) of the lid (9) aligned with the inlet end (35) of the dispensing line (32), (b) to store a length of the dispensing line (32) in a coiled configuration, and (c) to fluidly connect the inlet end (35) of the dispensing line (32) with the outlet of the beverage container (19);

wherein the beverage is dispensed by applying the pressure to the exterior surface of the beverage container (19) within the pressure chamber (2), and wherein, as the dispensing tap (55) is opened, the beverage container (19) collapses in response to the pressure applied thereto, thereby forcing the beverage out of the beverage container (19) into the dispensing line (32) and out of the dispensing tap (55).

2. The assembly of claim 1, wherein the connecting element (21) comprises:

a sealing member (37) configured to close the outlet of the beverage container (19); and a piercer (36) fluidly connected to the inlet end (35) of the dispensing line (32) and configured to pierce the sealing member (37) in response to the pressure applied to the exterior surface of the beverage container (19) so as to fluidly connect the inlet end (35) of the dispensing line (32) to the outlet of the beverage container (19).

3. The assembly of claim 1, wherein the connecting element (21) is fixed inseparably to the beverage container (19).

4. The assembly of claim 1, wherein the connecting element (21) includes a housing (41) configured to contain a coiled length of the dispensing line (32).

5. The assembly of claim 1, further comprising a heat transfer system operable on the pressure chamber (2).

6. The assembly of claim 5, wherein the heat transfer system includes a cooling unit (3).

7. The assembly of claim 6, further comprising ventilation means for ventilating air in the cooling unit (3).

8. The assembly of claim 6, wherein the pressure chamber (2) is operable as the cooling unit (3).

9. The assembly of claim 6, wherein the cooling unit (3) includes a cooling system selected from the group consisting of at least one of a liquid cooling system, a gas cooling system, and a Peltier cooling system.

10. The assembly of claim 6, wherein a temperature sensor is arranged in connection with the cooling unit (3) for measuring the temperature of the cooling unit (3).

11. The assembly of claim 10, wherein a control unit is arranged for controlling the cooling of the cooling unit (3) so that a predetermined temperature of the cooling unit (3) and thereby of the content of the beverage container (19) can be obtained.

12. The assembly of claim 6, wherein the cooling unit (3) is substantially made in one piece by a process selected from the group consisting of injection molding and punching.

13. The assembly of claim 12, wherein the cooling unit (3) is made of a moldable material.

14. The assembly of claim 6, wherein the cooling unit (3) is configured to contain at least one beverage container for pre-cooling.

15. The assembly of claim 6, wherein the cooling unit (3) comprises a door (6).

16. The assembly of claim 1, wherein the pressure chamber (2) includes a wall (8) substantially made in one piece by a process selected from the group consisting of injection molding and punching.

17. The assembly of claim 16, wherein the wall (8) of the pressure chamber (2) is made of a moldable material.

18. The assembly of claim 1, wherein the lid (9) closes off the pressure chamber (2).

19. The assembly of claim 1, wherein the lid (9) is detachable from the pressure chamber (2).

20. The assembly of claim 1, wherein the lid (9) is pivotably attached to the pressure chamber (2).

21. The assembly of claim 1, wherein the opening (22) in the lid (9) substantially is at the center of the lid (9).

22. The assembly of claim 18, wherein the lid (9) is lockable to the pressure chamber (2) by closing means.

23. The assembly of claim 1, wherein a pressure controlling unit is operably arranged with the pressure chamber (2).

24. The assembly of claim 1, wherein the pressure chamber (2) is pivotable to facilitate access to the pressure chamber (2).

25. The assembly of claim 24, further comprising a cooling unit (3) operable associated with the pressure chamber (2), and wherein the pressure chamber (2) includes pivot means arranged at the top of the pressure chamber (2) so that the center of rotation of the pressure chamber (2) is arranged at the top of the cooling unit (3).

26. The assembly of claim 25, wherein the center of rotation of the pressure chamber (2) is arranged at the back of the cooling unit (3).

27. The assembly of claim 25, wherein the pressure chamber (2) has a first position wherein it is in a use position, and a second position wherein it is in a loading/unloading position.

28. The assembly of claim 27, wherein the pressure chamber (2) in the second position is at the top of the cooling unit (3).

29. The assembly of claim 27, wherein the pressure chamber (2) comprises holding means for fixing the pressure chamber (2) in the first and second positions, respectively.

30. The assembly of claim 27, wherein the pressure chamber (2) comprises means for enabling the pivoting of the pressure chamber (2) between the first and second positions.

31. The assembly of claim 1, wherein the pressure chamber (2) includes slide means for making it slidable.

32. The assembly of claim 1, wherein the beverage container (19) is substantially completely collapsed and non-reusable after use.

33. The assembly of claim 32, wherein the beverage container (19) is made of a plastic material.

34. The assembly of claim 33, wherein the plastic material is a polymer selected from the group consisting of PEN, PET, and blended PET.

35. The assembly of claim 32, wherein the beverage container (19) is of a multilayer construction comprising an oxygen barrier.

36. The assembly of claim 32, wherein the beverage container (19) is colored so as to create a barrier to light.

37. The assembly of claim 32, wherein the beverage container (19) is configured to be contained inside a packaging box (20) before being loaded into the pressure chamber (2).

38. The assembly of claim 37, wherein the packaging box (20) comprises a bottom part (73) configured to support the beverage container (19), and a top part (72) that is removable from the bottom part (73).

39. The assembly of claim 38, wherein the pressure chamber (2) is operable as a cooling unit (3), and wherein the top part (72) is configured for removal before the beverage container (19) and the bottom part (73) are placed in the cooling unit (3) for pre-cooling.

40. The assembly of claim 1, wherein a ring-shaped sealing element (51) is arranged at the inside of the lid (9) and the connecting element (21) during use.

41. The assembly of claim 40, wherein the ring-shaped sealing element (51) includes a main part (52), a lip (53), and a plurality of tabs (54) placed around the main part (52) with a mutual spacing on the opposite side of the lip (53).

42. The assembly of claim 1, wherein the dispensing line (32) has an outlet end, the assembly further comprising a dispensing valve (33) at the outlet end of the dispensing line (32).

43. The assembly of claim 42, wherein the dispensing valve (33) is interchangeable with another dispensing valve.

44. The assembly of claim 6, wherein a tower (7) is arranged in connection with the cooling unit (3).

45. The assembly of claim 44, wherein the dispensing tap (55) is arranged at the tower (7).

46. The assembly of claim 1, further comprising a cooling system configured for cooling the dispensing line (32).

47. The assembly of claim 6, wherein a plurality of pressure chambers is arranged in the cooling unit.

48. The assembly of claim 1, wherein a plurality of beverage containers is arranged in a single pressure chamber.

49. The assembly of claim 48, wherein each beverage container is connected to a dispensing line.

* * * * *

UNITED STATES PATENT AND TRADEMARK OFFICE

CERTIFICATE OF CORRECTION

PATENT NO. : 8,899,445 B2
APPLICATION NO. : 12/063504
DATED : December 2, 2014
INVENTOR(S) : Jan N. Rasmussen It is certified that error appears in the above-identified patent and that said Letters Patent is hereby corrected as shown below:

In the Specification

In column 2, line 20, delete “containers” and insert -- containers, even --, therefor.

In column 2, line 21, delete “heavy” and insert -- heavy, easily --, therefor.

In column 3, line 15, delete “assembly” and insert -- assembly, --, therefor.

In column 3, line 21, delete “and” and insert -- and, --, therefor.

In column 4, line 23, delete “vell” and insert -- well --, therefor.

In column 5, line 53, delete “invention” and insert -- invention, --, therefor.

In column 8, line 45, delete “description” and insert -- description, --, therefor.

In column 9, line 35, delete “cooling,” and insert -- cooling --, therefor.

In column 9, line 40, delete “1,” and insert -- 1 --, therefor.

In column 11, line 47, delete “shown)” and insert -- shown), --, therefor.

In column 12, line 14, after “the” insert -- neighboring --.

In column 12, line 41, delete “1” and insert -- 1' --, therefor.

In column 13, line 37, after “end” insert -- are --.

In column 13, line 51, delete “position.” and insert -- position, --, therefor.

In column 14, line 15, delete “28:” and insert -- 28; --, therefor.

In column 15, line 52, after “line” insert -- 32 --.

In column 15, line 66, delete “fining.” and insert -- fitting. --, therefor.

In column 17, line 40, delete “maneuvered” and insert -- manoeuvred --, therefor.

In column 17, line 48, after “47,” insert -- the --.

In column 18, line 22, delete “loosing” and insert -- losing --, therefor.

In column 19, line 44, delete “sec- and” and insert -- second --, therefor.

Signed and Sealed this
Twenty-eighth Day of April, 2015

Michelle K. Lee

Michelle K. Lee
*Director of the United States Patent and Trademark Office*